US005678157A

United States Patent [19]

Yoshida et al.

[11] Patent Number: 5,678,157

[45] Date of Patent: Oct. 14, 1997

[54] REGENERATING APPARATUS OF RECORDING MEDIUM

[75] Inventors: Masazumi Yoshida, Amagasaki; Junji Machida, Toyonaka; Susumu Tanaka, Hoi-Gun; Kaoru Furusawa, Toyonaka, all of Japan

[73] Assignee: Minolta Co., Ltd., Osaka, Japan

[21] Appl. No.: 330,190

[22] Filed: Oct. 27, 1994

[30] Foreign Application Priority Data

| | | | |
|---|---|---|---|
| Oct. 28, 1993 | [JP] | Japan | 5-270356 |
| Oct. 28, 1993 | [JP] | Japan | 5-270358 |
| Nov. 2, 1993 | [JP] | Japan | 5-274384 |

[51] Int. Cl.[6] ..... G03G 21/00

[52] U.S. Cl. ..... 399/390; 162/265

[58] Field of Search ..... 355/202, 297, 355/308; 15/77; 162/4, 265; 118/70, 203, 257, 424, 423; 156/281; 399/390

[56] References Cited

U.S. PATENT DOCUMENTS

| | | | |
|---|---|---|---|
| 3,630,776 | 12/1971 | Barr | 355/297 |
| 5,353,108 | 10/1994 | Tsukamoto | 355/296 |
| 5,400,123 | 3/1995 | Sato et al. | 15/77 X |
| 5,545,381 | 8/1996 | Iida et al. | 355/202 X |

FOREIGN PATENT DOCUMENTS

| | | |
|---|---|---|
| 1-42662 | 2/1989 | Japan . |
| 4-16978 | 1/1992 | Japan . |
| 4-89271 | 3/1992 | Japan . |
| 4-356086 | 12/1992 | Japan . |
| 5-173454 | 7/1993 | Japan . |
| 6-89068 | 9/1994 | Japan . |

*Primary Examiner*—Nestor R. Ramirez
*Attorney, Agent, or Firm*—Sidley & Austin

[57] ABSTRACT

A main body of a regenerating apparatus of a recording medium has a conveyor mechanism which conveys a recording medium to be regenerated along a conveyance passage. A cleaning unit is removably mounted on the main body for easy maintenance, cleaning or replacement. Preferably, the cleaning unit has a U-shaped conveyance passage of the recording medium filled up with a cleaning liquid, and an image removing mechanism which applies a physical treatment to the surface of the recording medium. The recording medium is taken in the U-shaped conveyance passage, immersed in the cleaning liquid so that the image on the recording medium is swollen and removed by the image removing mechanism. The image removing mechanism may include a web impregnated with cleaning liquid brought into contact with the recording medium by a roller which may have a built-in heater to cause the printing material on the recording medium to swell and be scraped off by the web.

20 Claims, 15 Drawing Sheets

REGENERATING APPARATUS OF RECORDING MEDIUM

BACKGROUND OF THE INVENTION

1. Field of the Invention

The present invention relates to a regenerating apparatus recording medium which removes printing material on a recording medium printed by image forming equipment such as copiers and printers to regenerate the recording medium.

2. Description of the Prior Art

Conventionally, a regenerating apparatus for removing a toner image formed on a recording paper to recycle the recording paper is publicly known in Japanese Non-examined Patent Publication No. 4-89271, 5-173454 and so on. The former apparatus applies a physical treatment to the surface of the recording paper to remove the toner image after applying a cleaning liquid to the surface of the recording paper with a roller. The later apparatus liberates and removes the toner image by immersing the recording paper in a cleaning liquid such as dispersant, etc.

In the above mentioned apparatus, however, since the regeneration treatment portion is built integrally with the apparatus body, it is extremely difficult to carry out maintenance of the apparatus. Therefore, as the regeneration treatment is repeated, the printing material separated and liberated from the recording medium adheres to the apparatus inside or condenses in the cleaning liquid, giving rise to a problem of greatly degrading the cleaning effect. This tendency is particularly conspicuous with the electrophotographic copiers or printers which use resin components in the printing material, in which resin melts and adheres to the cleaning brush, etc., making it difficult to regenerate the recording medium.

In addition to the above disadvantage, the immersion type regenerating apparatus has a disadvantage that it requires a container to hold the cleaning liquid and a cleaning unit to keep the cleaning liquid constantly clean, causing the size of apparatus body to be enlarged.

SUMMARY OF THE INVENTION

The present invention has been developed to substantially eliminate the above-described disadvantages.

It is an object of the present invention to provide a regenerating apparatus of recording medium in which it is easy to carry out a maintenance of the regeneration treatment portion.

It is an another object of the present invention to provide a regenerating apparatus of recording medium which is downsized.

It is a still another object of the present invention to provide image forming equipment having a regenerating apparatus which is removable from the equipment body.

In order to achieve the aforementioned object, there is provided a regenerating apparatus of recording medium, image forming equipment, and a regenerating unit as described below.

1. According to the first aspect of the invention, a regenerating apparatus of recording medium comprises:
   - a main body having a conveyor mechanism which conveys a recording medium to be regenerated along conveyance passage; and
   - a cleaning unit which is removably mounted on the main body, the regenerating unit taking in the recording medium conveyed from the main body to remove an image on the recording medium.

Preferably, the regenerating unit may have engaging members, the engaging members engaging with support members provided on the main body, whereby the cleaning unit is mounted on the main body.

The main body may preferably have an image forming mechanism which forms an image on a recording medium regenerated by the cleaning unit.

In one preferred embodiment, the cleaning unit may have U-shape conveyance passage of the recording medium filled up with a cleaning liquid, and an image removing mechanism which applies a physical treatment to the surface of the recording medium, whereby the recording medium is taken in the U-shape conveyance passage, immersed in the cleaning liquid so that the image on the recording medium is swollen and removed by the image removing mechanism.

In this embodiment, the regenerating unit may further comprise a pre-cleaning unit which is removably mounted on the main body, the pre-cleaning unit having U-shape conveyance passage filled up with a cleaning liquid, whereby the recording medium is taken in the U-shape conveyance passage of the pre-cleaning unit from the main body, immersed in the cleaning liquid so that the image on the recording medium is swollen, and conveyed to the cleaning unit.

In addition, the regenerating apparatus may further comprise a post-cleaning unit which is removably mounted on the main body, the post-cleaning unit having U-shape conveyance passage filled up with a cleaning liquid, whereby the recording medium is taken in the U-shape conveyance passage of the post-cleaning unit from said cleaning unit, immersed in the cleaning liquid so that a floating toner adhering to the recording medium is washed away, and returned to the main body.

In the other preferred embodiment, the cleaning unit may comprise a conveyor mechanism which conveys the recording medium to be regenerated along a conveyance passage, a first roll around which a web is wrapped, a second roll which takes up the web wrapped around the first roll, a roller which allows the web fed from the first roll to the second roll to come in contact with the recording medium conveyed by the conveyor mechanism, and a cleaning liquid applying mechanism which applies a cleaning liquid to the recording medium conveyed by the convey mechanism.

In this embodiment, the roller may have a built-in heater.

As a first type of the cleaning liquid applying mechanism, it may be arranged on the upstream side of the conveyance direction of the recording medium with respect to the roller to apply the cleaning liquid to the recording medium conveyed by the convey mechanism.

The cleaning liquid applying mechanism may include two rollers spaced along the conveyance passage and an applicator belt wrapped around the rollers, whereby the cleaning liquid applying mechanism applies the cleaning liquid to the applicator belt so that the cleaning liquid is applied to the recording medium via the applicator belt.

The cleaning liquid applying mechanism may further include a heater which is arranged in a position opposed to the applicator belt via the conveyance passage of the recording medium to heat the recording medium.

As a second type of the cleaning liquid applying mechanism, it may be arranged on the upstream side of the feed direction of the web with respect to the roller to apply the cleaning liquid to the web fed from the first roller so that the cleaning liquid is applied to the recording medium via the web.

In the still other preferred embodiment, the cleaning unit may comprise a conveyor mechanism which conveys the recording medium to be regenerated along a conveyance passage, a first roll around which a web impregnated with a cleaning liquid previously is wrapped, a second roll which takes up the web wrapped around the first roll, a roller which allows the web fed from the first roll to the second roll to come in contact with the recording medium conveyed by the conveyor mechanism so that the cleaning liquid is applied to the recording medium via the web.

2. According to the second aspect of the invention, an image forming equipment comprises:
   - a main body having guide members;
   - a image forming mechanism which forms an image on a recording medium;
   - at least one feeder which stores recording media to be used for forming an image, the feeder being removably mounted on the guide members; and,
   - a regenerating mechanism which removes an image on a recording medium to be regenerated, the regenerating mechanism being removably mounted on the guide member for the feeder.

In a preferred embodiment, the image forming equipment may comprise:
   - at least one secondary feeder which stores recording media to be used for forming an image, the secondary feeder being separated from the feeder; and
   - a conveyor mechanism which conveys a recording medium regenerated by the regenerating unit to the secondary feeder.

3. According to the third aspect of the invention, a regenerating unit comprises engaging members on the opposed outer side surfaces thereof, the engaging members engaging with guide members provided on a main body of image forming equipment, the guide member guiding at least one feeder of recording media to removably mount on the main body, whereby the regenerating unit is replaceable with the feeder.

BRIEF DESCRIPTION OF THE DRAWINGS

Further objects and advantages of the present invention will become clear from the following description taken in conjunction with the preferred embodiments thereof with reference to the accompanying drawings.

DETAILED DESCRIPTION OF THE PREFERRED EMBODIMENTS

1. Regenerating apparatus

Referring now to FIG. 1–7, an embodiment of regenerating apparatus according to the present invention will be described in detail hereinafter.

Figure 1:
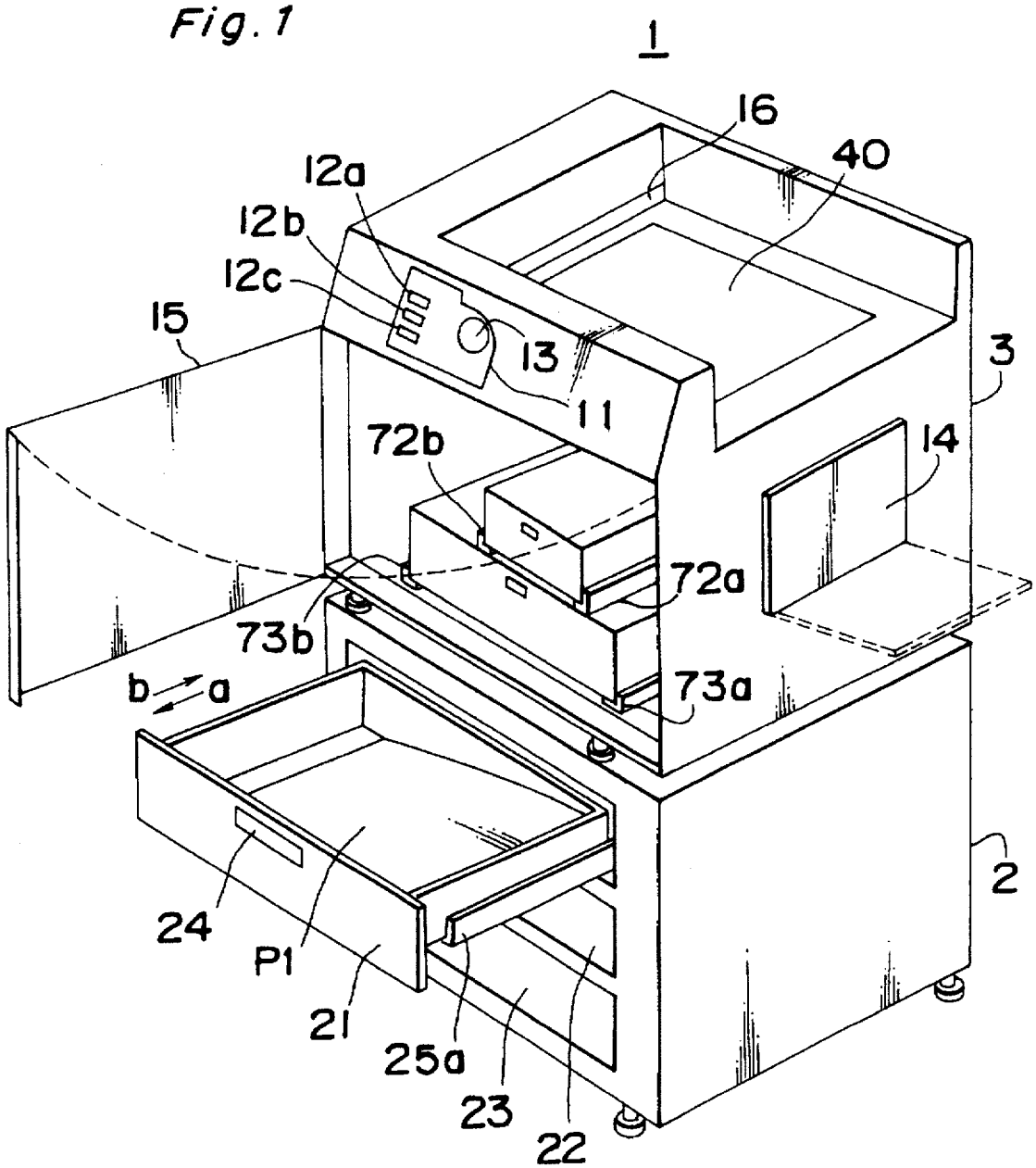
FIG. 1 is a perspective view of a regenerating apparatus according to the present invention.

FIG. 1 shows a regenerating apparatus 1. The regenerating apparatus 1 comprises a stock unit 2 for storing a recording medium and a regenerating unit 3 for carrying out regenerating treatment of the recording medium. In FIG. 1, the stock unit 2 is located below the regenerating unit 3 but it may be designed to be located on the side of the regenerating unit 3.

The regenerating apparatus 1 is provided with an operation panel 11 on the top surface, on which selector keys 12*a*, 12*b* and 12*c* and a start key 13 are arranged. The apparatus 1 is also provided with a manual feeding tray 14 on the side surface, a door 15 on the front surface, and a discharge outlet 16 on the top surface of the regenerating unit 3.

The stock unit 2 is similar to a paper feeder unit of ordinary electrophotographic copiers. The stock unit 2 in this embodiment is equipped with cassettes 21, 22 and 23 which classify and store the recording medium by sizes. The cassette 21 can be pulled out along guide members 25*a* and 25*b* by pulling a handle 24 in the arrow (a) direction in FIG. 1. The cassettes 22 and 23 are designed to be pulled out along guide members in the similar manner as the cassette 21. After loading the recording medium P1 in the cassette, the cassette 21 is pushed in the arrow (b) direction to return into the stock unit 2.

Figure 2:
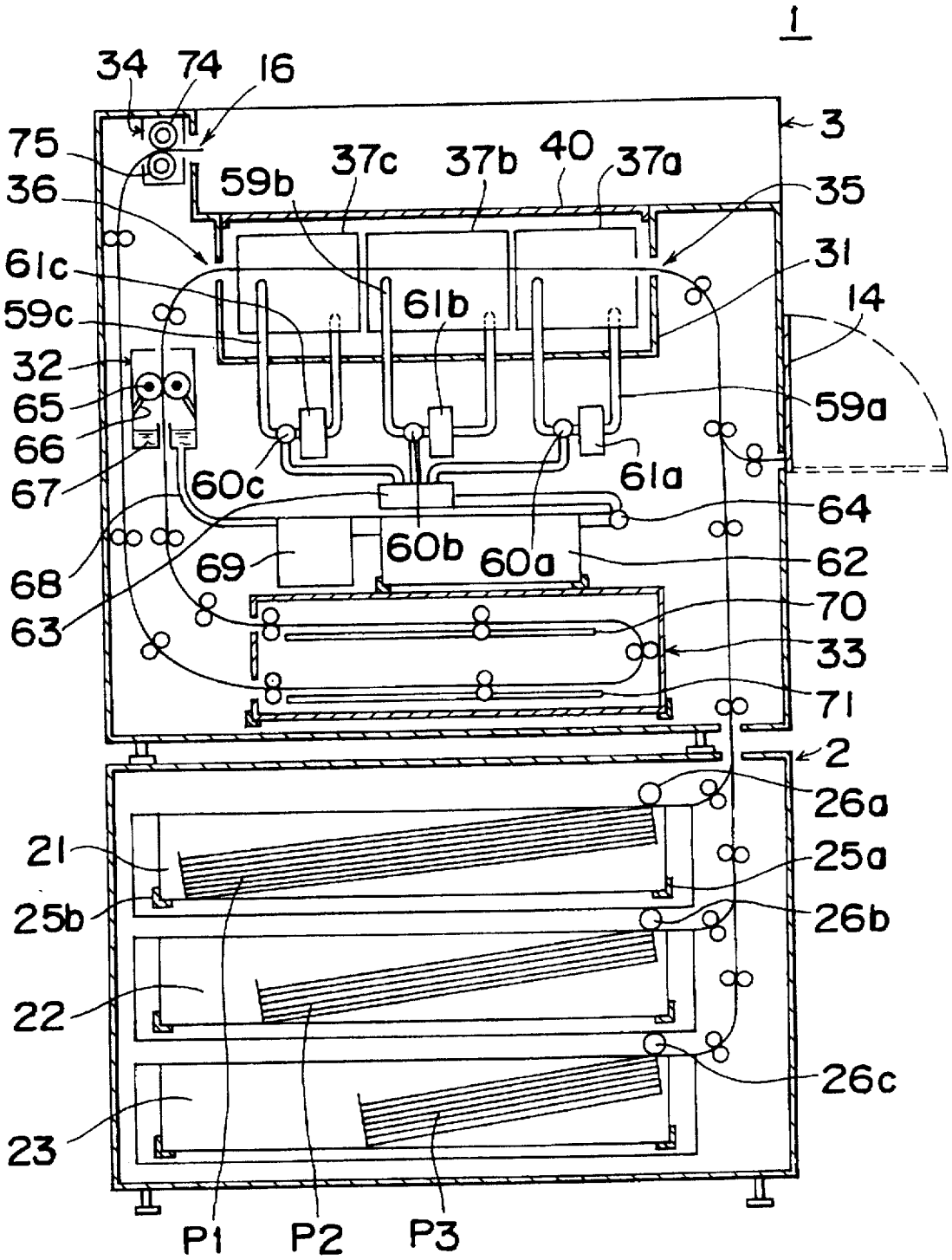
FIG. 2 is a sectional view of the regenerating apparatus illustrated in FIG. 1.
Figure 3:
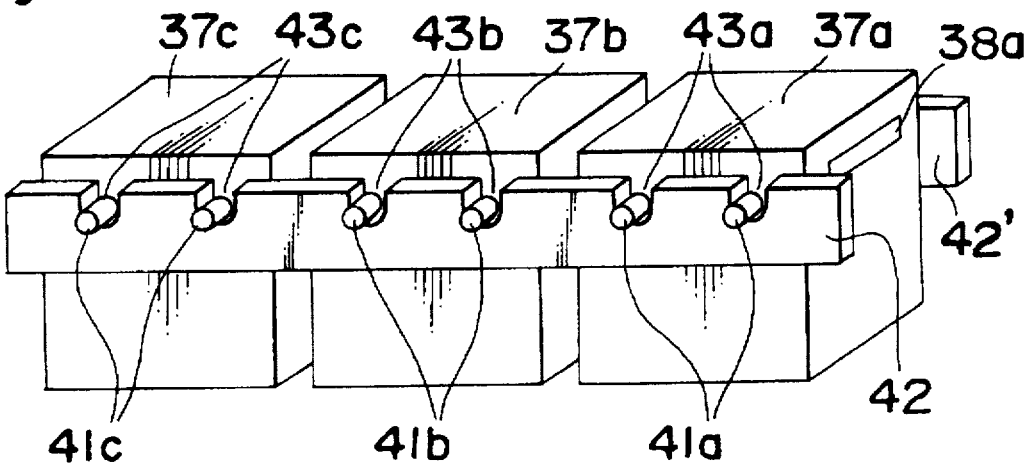
FIG. 3 is a perspective view showing an engagement relationship between a maintenance tank and each cleaning unit of the regenerating apparatus illustrated in FIG. 2.
Figure 4:
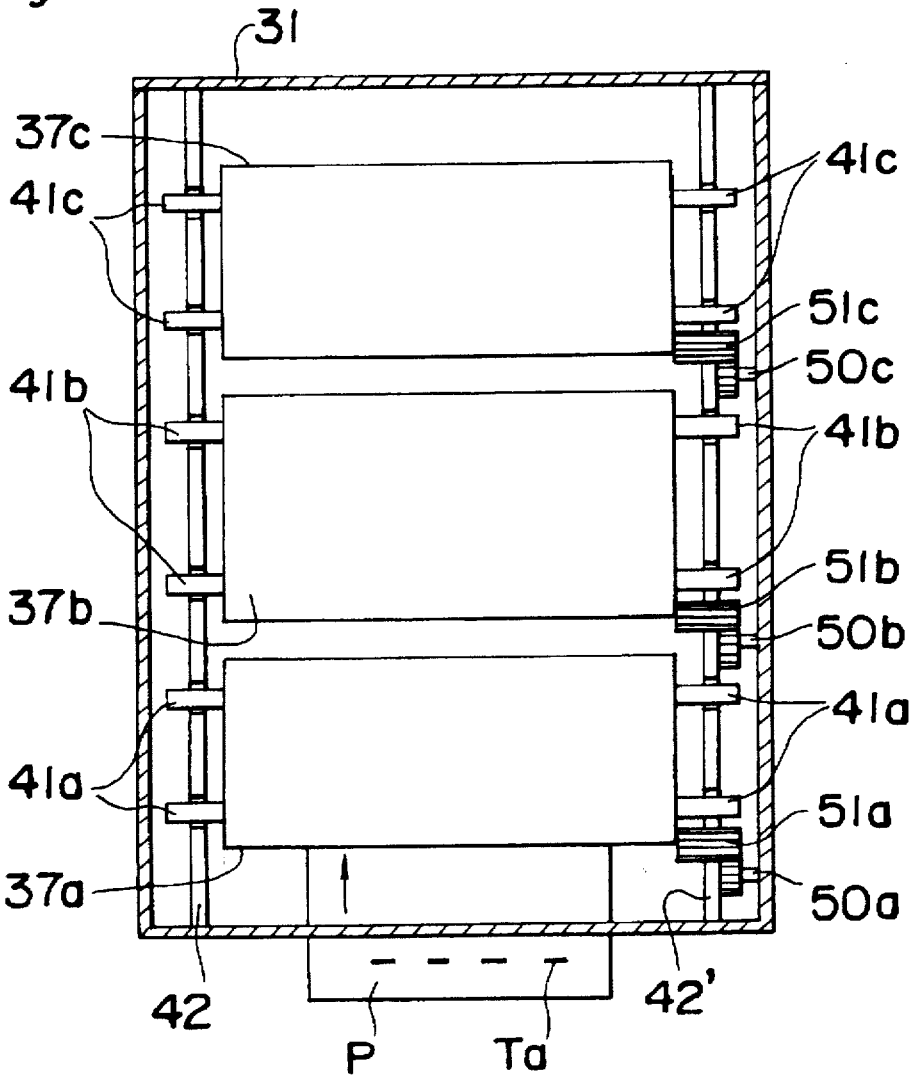
FIG. 4 is a top view of the maintenance tank and each cleaning unit of the regenerating apparatus illustrated in FIG. 2.

P1–P3 in FIG. 2 denote recording media, which are paper or so-called OHP sheets such as polyester film, etc. on which toner images containing at least resin component are recorded. In this embodiment, the cassette 21 stores A3 size recording medium P1 and the cassettes 22 and 23 store B4 and A4 size recording media P2, P3, respectively, in the longitudinal feeding direction.

The recording media stored in the cassettes 21, 22 and 23 are brought into pressure-contact with regulating rollers 26*a*, 26*b* and 26*c*, respectively, by an energizing means not illustrated.

Now, the regenerating unit 3 will be described in detail.

The regenerating unit 3 comprises a maintenance tank 31 which houses cleaning units for immersing the recording medium in a cleaning liquid to remove printed letters, a squeeze unit 32 for squeezing the cleaning liquid adhering to the recording medium, and drying units 33, 34 for drying the recording medium.

The maintenance tank 31 has openings 35, 36 in both side surfaces and houses three cleaning units, namely, a pre-cleaning unit 37*a*, main cleaning unit 37*b*, and post-cleaning unit 37*c*. The pre-cleaning unit 37*a* brings the recording medium in contact with the cleaning liquid initially to thoroughly swell the toner. The main cleaning unit 37*b* applies physical treatment to the printed letter surface swollen and coming up from the recording medium surface and removes the printed letters. The post-cleaning unit 37*c* brings the recording medium in contact with the cleaning liquid again and washes out the toner once separated but again adhering to the recording media. To each unit, an inlet 38*a*, 38*b*, 38*c* and an outlet 39*a*, 39*b*, 39*c* are formed, respectively, and the recording medium is designed to be conveyed from the cleaning unit 37*a*, a 37*b*, then to 37*c* successively.

The top of these cleaning units is covered with a lid 40 which can be opened and closed.

On the outside surface of each cleaning unit 37*a*–37*c*, four each engaging pins 41*a*, 41*b* and 41*c* are equipped, two on the front surface and two on the back surface. On the other hand, in the inside of the maintenance tank 3, a pair of support plates 42, 42' are bridged along the conveyance direction of the recording medium P. On the upper part of the support plates, grooves 43*a*, 43*b* and 43*c* are provided at the position that the engaging pins 41*a*, 41*b* and 41*c* are engaged. With these grooves, each cleaning unit is removably mounted to the support plates 42, 42' and at the same time is housed horizontally in the maintenance tank 31. Each cleaning unit housed in the maintenance tank 31 can be easily taken out from the regenerating apparatus by pulling up them vertically through the lid 40. This construction ensures easy cleaning of the cleaning units and easy maintenance only by replacing a used cleaning unit with a freshly prepared unit, solving the problem of contaminating the vicinity of the regenerating apparatus or excessively degrading the regeneration efficiency due to the contaminated cleaning liquid.

The inside construction of each cleaning unit will be described below.

Figure 5:
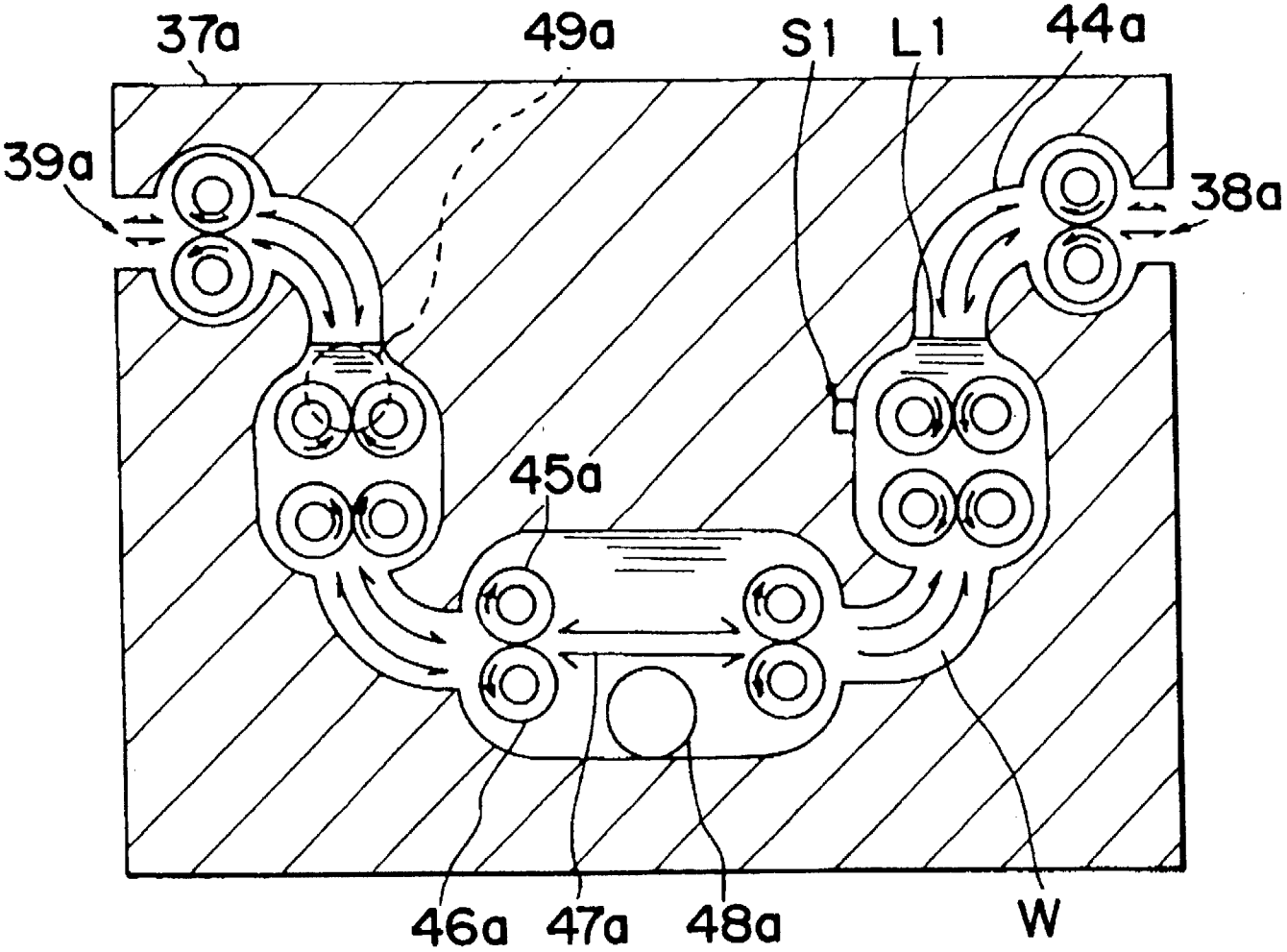
FIG. 5 is a cross sectional view of a pre-cleaning unit of the regenerating apparatus illustrated in FIG. 2.

FIG. 5 shows the pre-cleaning unit 37*a*.

Between the inlet 38*a* and the outlet 39*a* of the pre-cleaning unit 37*a*, an U-shape conveyance passage 44*a* is formed. The conveyance passage 44*a* is filled up with the cleaning liquid W as discussed hereinafter. In the figure, L1 denotes the interface of the cleaning liquid. Designing the conveyance passage of the recording medium in a U-shape ensures a sufficiently long transport distance of the recording medium in the cleaning liquid without upsizing the unit. This also enables the reduction of the total volume of the cleaning substance which fills the conveyance passage.

In the traveling passage 44*a* are provided a plurality of roller pairs 45*a*, 46*a*. Between the roller pairs, guide plates 47*a* are mounted to prevent the recording media from winding around the roller pairs.

Figure 6:
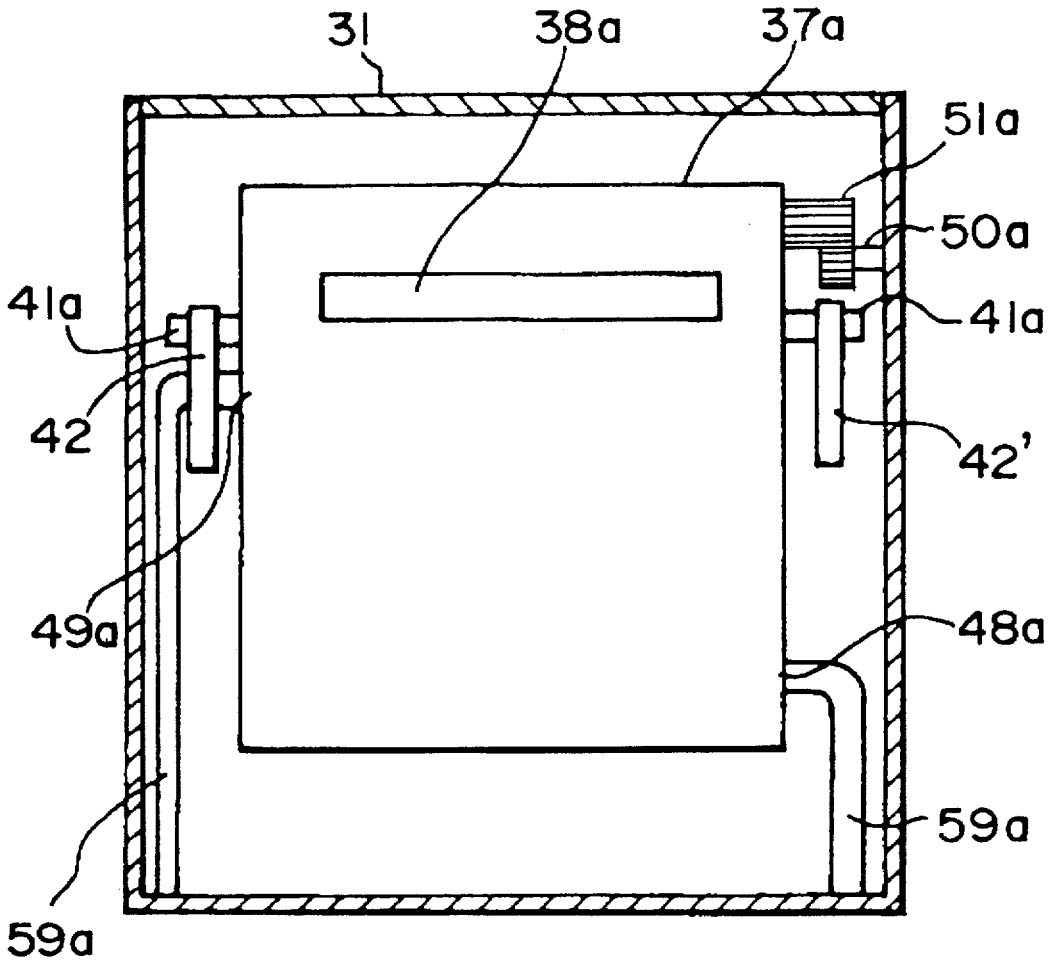
FIG. 6 is a cross sectional view of the maintenance tank of regenerating apparatus illustrated in FIG. 2.

On the side wall of the pre-cleaning unit 37*a*, as shown in FIG. 6, openings 48*a* and 49*a* as described hereinafter are provided in addition to the engaging pins 41*a*. On the cleaning unit side wall, a gear 51*a* is further provided, which engages with a drive gear 50*a* provided inside the maintenance tank 31 and rotates for driving. The roller pairs inside the conveyance passage 44*a* described above are connected to the gear 51*a* and are designed to rotate for driving, respectively.

For the cleaning liquid used in the regenerating apparatus of this invention, the liquid which does not dissolve the dye components such as charge controlling agent in the toner, etc. or colorant components such as pigments, etc. but swells the resin component composing the toner and makes the toner plastic, and allows the toner images to emerge on the surface from the inside of the recording medium should be used. For the cleaning liquid to be used in this invention, for example, TOSCLEAN D commercially available from Nagamune Sangyo as a water-based cleaning agent is applicable. TOSCLEAN D is a water-based detergent containing tall oil fatty acid ester, tall oil fatty acid and surfactant and is a light yellow transparent liquid with physical properties of acid number: about 2.1 mgKOH/g, specific gravity: 1.020 (20° C.), and pH: 7±0.5 (15° C.). This cleaning liquid does not contain any fluorine or carbon chloride compounds which are condemned for destroying the ozone layer, and can be used without deteriorating the earth environment. In addition, because it causes low toxicity to the human body and is nonflammable (no flash point), it is extremely suited for application to a paper regenerating apparatus in the regular office environment as in the case of this invention.

Immersion conditions of the recording medium in the cleaning liquid may be set as required with the types of recording media, printing materials, and cleaning liquids taken into account, but in any case, they must be set in such a manner that the fixed toner on the recording media is brought to be readily removable from the recording medium by the printed letters removing means in the main cleaning unit 37*b* later discussed. The contact time with the cleaning liquid differs depending on the types of the recording medium, printing material, or cleaning liquid, but it is, in general, desirable to set to scores of seconds to a few minutes.

Figure 7:
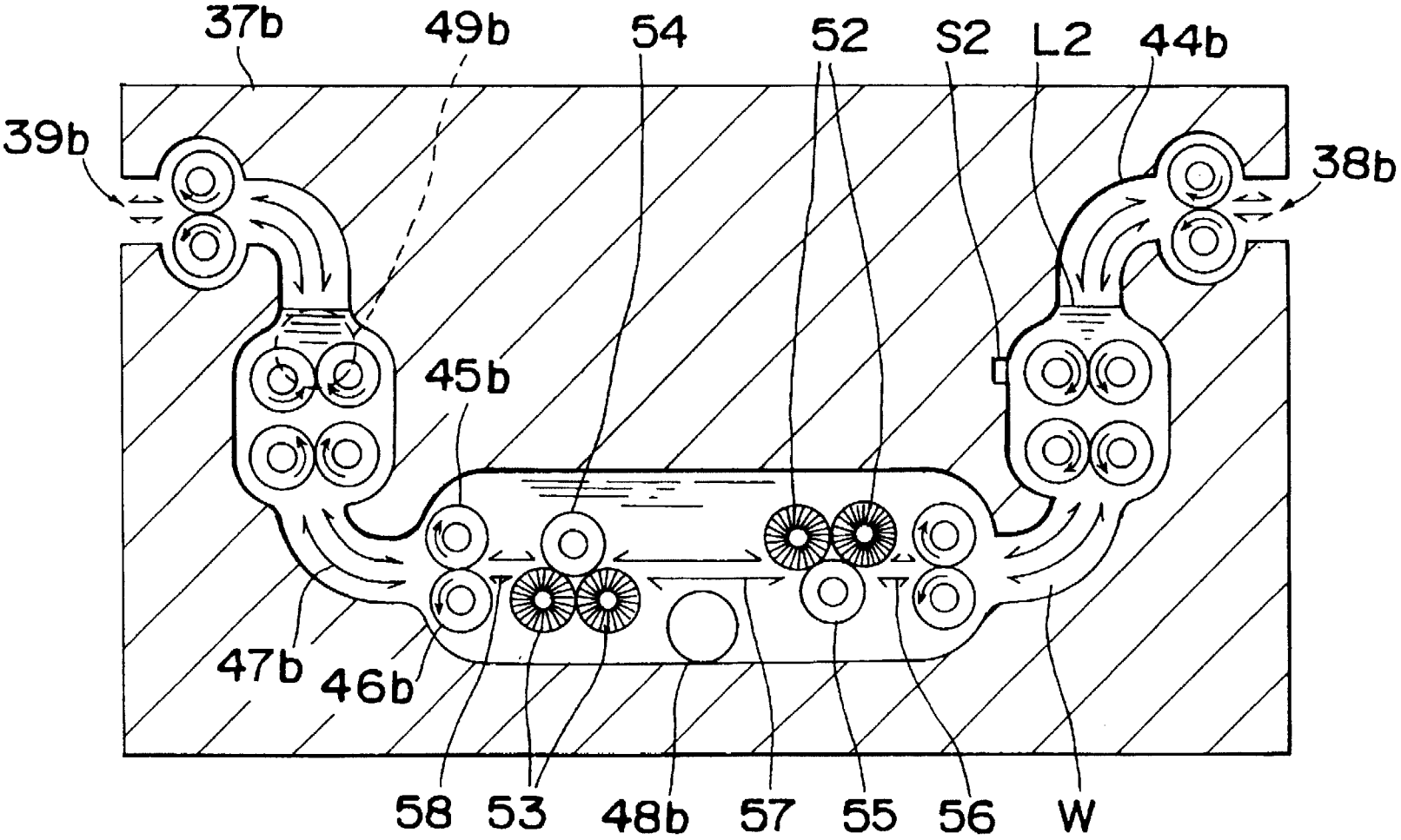
FIG. 7 is a cross sectional view of a main cleaning unit of the regenerating apparatus illustrated in FIG. 2.

FIG. 7 shows the main cleaning unit 37*b*.

Between the inlet 38*b* and the outlet 39*b* of the main cleaning unit 37*b*, an U-shape conveyance passage 44*b* filled up with the cleaning liquid W is formed in the same manner as the pre-cleaning unit 37*a*. In the FIG. 7, L2 shows the liquid level of the cleaning liquid. In the conveyance passage 44*b* are provided a plurality of roller pairs 45*b*, 46*b* and guide plates 47*b*. At the bottom of the U-shape conveyance passage 44*b*, rotating image removing brush pairs 52 and 53 are provided as a means for removing an image (printed letters). For each brush pair, opposed rollers 54, 55 are mounted so that the brush bristle portion of the rollers come in pressure-contact with these roller surfaces. With this arrangement, it is possible to carry out cleaning treatment on both surfaces of the recording medium in one regenerating process even if both surfaces of the recording medium are printed. Numerals 56, 57 and 58 denote guide plates for preventing the recording medium from winding around the rotating brushes.

For the material composing the brush bristle of the rotating brush, high molecular fibers such as nylon, acrylic, polyester, etc. or fibers such as wool are suitably used.

As a form for a printed letter removing means, it is not limited to the above-mentioned rotating brush form. Examples include a fixed type blade, rotating surface-roughened roller, or rotating roller wound with unwoven fabric cloth, etc. For the material to be carried by these brushes, metal, synthetic fibers, natural fibers, high molecular elastic substance, etc. may be applicable.

The post-cleaning unit 37*c* has the exactly same internal construction and appearance as that of the pre-cleaning unit 37*a*.

The toner separated from the recording medium surface by the printed letter removing treatment floats and suspends in the cleaning liquid or condenses in large plastic granular form. Leaving these in the cleaning liquid as they are may allow them to adhere to or to be adsorbed by the cleaned recording medium, resulting in image noise. Consequently, it is desirable for the regenerating apparatus of this invention to clean the cleaning liquid which contains the floating printing materials such as the separated toner, dissolved ink, or pencil powders removed from the recording medium.

Next, discussion will be made on the cleaning mechanism of the cleaning liquid related to this embodiment. Because this mechanism is common to all cleaning units, the discussion will be made referring to the pre-cleaning unit 37*a*.

In FIG. 5, on the cleaning unit side wall is provided an opening 48*a* for discharging the cleaning liquid from the conveyance passage 44*a* and an opening 49*a* for introducing the cleaning liquid.

As shown in FIG. 2 and 6, to the openings 48*a*, 49*a* of the unit side wall, a circulation tube 59*a* is connected so that the cleaning liquid in the unit is circulated by a pump 60*a* in the direction orthogonally intersecting the conveyance direction of the recording media. On the upstream side of the pump with respect to the circulating direction of the cleaning liquid in the course of the conveyance passage, a filter 61*a* is provided.

The filter medium is designed to be replaceable as required. It is desirable to provide a means for sucking the cleaning liquid from the cleaning unit and a means for supplying the cleaning liquid to the cleaning unit again after cleaning the sucked cleaning liquid by trapping or removing by adsorption with the filter filled with filter medium such as glass wool or activated coal. This design can prevent re-adhesion of the separated toner to the recording medium surface as well as suppress contamination of the cleaning liquid to the minimum, thereby extending the maintenance intervals. The cleaning liquid can be used repeatedly until the effects are degraded, achieving good economy. For the filter medium material, for example, glass wool, activated coal, and natural fiber cloth can be applied.

It is possible to constantly supply the clean cleaning liquid to the recording medium by circulating the cleaning liquid against the conveyance direction of the said recording medium. In this event, it is possible to prevent more effectively re-adhesion or re-adsorption of the toner once separated from the recording medium and floating or condensed in the cleaning liquid, making it possible to secure a regenerated recording medium with higher whiteness.

Numeral 62 in FIG. 2 denotes a make-up bottle, which contains a specified volume of make-up cleaning liquid. In FIG. 5, in the vicinity of the cleaning liquid level L1, a sensor S1 is mounted to detect shortage of the cleaning liquid in the unit. When the cleaning liquid in the unit is consumed as regeneration treatment of the recording medium proceeds and the liquid level L1 lowers to the position of the sensor S1, the sensor sends a signal to make up the cleaning liquid from the make-up bottle 62 as required. In this embodiment, the cleaning liquid is designed to be automatically fed as required to each unit in response to the make-up signal sent to each unit 37*a*–37*c* using a distributor 63 and a pump 64.

In the inside of the openings 48*a* and 49*a*, reverse flow check valves (not shown) are provided, preventing the cleaning liquid from leaking out even when the engagement with the circulation tube is released.

In the squeeze unit 32 are installed a roller pair 65 which squeeze out an excess cleaning liquid from the recording medium surface from which printed letters are removed. In this embodiment, for the roller pair 65, a silicon rubber made porous roller is used. However any roller such as urethane sponge roller or metal blade which can remove the excess cleaning liquid can be used. Against the surface of the roller pair 65, a blade 66 is pressed so that the excess cleaning liquid is recovered into a reservoir 67 with this blade. The squeeze unit 32 is connected to a cleaner 69 by a connection passage 68. The cleaner 69 contains a filter medium such as glass wool and an electromagnetic pump. The excess cleaning liquid recovered in the reservoir 67 is sent to the make-up bottle 62 after impurities in the liquid are removed by the cleaner, and reused.

The first dryer unit 33 comprises a heater 70 which is designed to dry the recording medium from the front surface and a heater 71 which is designed to dry it from the rear surface. In this embodiment, ceramic heaters are used, which are heated with the electric supply not illustrated and utilize convection heat generated. For the dryer unit, any types which utilize hot air or contain a heating medium in the roller pair may be used in addition to the heaters mentioned above.

In this embodiment, as shown in FIG. 1, the make-up bottle 62 and the first dryer unit 33 are arranged to be able to be pulled out by the guides 72*a*, 72*b*, 73*a* and 73*b* with the door 15 of the regenerating unit 3 open.

The second dryer unit 34 has a metal roller pair comprising an upper roller 74 and a lower roller 75. The rollers are pressure-contacted each other and contain heaters inside each roller.

The reason why the dryer units are installed in multiple stages as the first dryer unit 33 and the second dryer unit 34 as described above is because applying a large volume of calories at a stretch to dry the recording medium generates wrinkles, etc. on the recording medium. In this embodiment, the recording medium is naturally dried in the course of transportation to the second dryer unit 34 after it passes the first dryer unit 33. Consequently, excessive heat is not applied to the recording medium and inconvenience such as deformation can be further effectively prevented.

This embodiment is designed to take out the cleaning unit storing the cleaning liquid vertically from the top of the regenerating apparatus proper as shown in FIG. 2. This design is particularly effective for prevention of boil-over of the cleaning liquid. However, this invention is not limited to this but can be applied to any design in which the cleaning unit storing the cleaning liquid is mounted removably to the regenerating apparatus proper. For example, in FIG. 1, there mentioned is a design in which the door 15 on the front surface of the regenerating apparatus is opened and the cleaning unit can be pulled out toward this side of the apparatus. In addition, it is possible to install a filter in the vicinity of the cleaning unit and to replace the unit and the filter together.

The operation of the regenerating apparatus 1 constructed as described above will be discussed hereinafter.

After selecting the cassette 21, 22 or 23 with selector keys 12*a*–12*c* on the operation panel 11, pressing on the start key 13 causes the recording medium to be pulled out from the specified cassette of the stock unit 2 and conveyed into the regenerating unit 3. Recording media of sizes which cannot be stored in the cassettes 21, 22 or 23 or thick recording media which are difficult to convey from the cassettes are fed directly to the regenerating unit 3 from the manual feeding tray 14.

The recording medium in the regenerating unit 3 is first conveyed from the opening 35 to the maintenance tank 31.

The recording medium fed into the pre-cleaning unit 37*a* from the inlet 38*a* are conveyed successively in the cleaning liquid W along the conveyance passage 44*a* by the roller pairs 45*a*, 46*a*.

The printing material (fixed toner: Ta) on the recording medium is swollen by the action of the cleaning liquid W while it passes in the cleaning liquid W.

After passing the conveyance passage 44*a*, the recording medium is discharged from the discharge outlet 39*a* and conveyed to the inside of the main cleaning unit 37*b* through the inlet 38*b*. The recording media are conveyed successively in the conveyance passage 44*b* by the roller pair 45*b*, 46*b*. The rotating brush pair 52 apply the physical force to the front surface of the recording medium, while the brush pair 53 apply the physical force to the rear surface of the recording medium. The printed letter portion is removed by these brush pairs 52, 53.

After printed letters are removed from the recording medium surface as described above, the recording medium is discharged from the main cleaning unit 37*b* through the discharge outlet 39*b*, and is then conveyed to the inside of the post-cleaning unit 37*c* through the inlet 38*c*.

Inside the post-cleaning unit 37*c*, the floating toner adhering to the surface of the recording medium is washed away by being brought in contact with the cleaning liquid W.

The cleaning liquid W in each cleaning unit 37*a*, 37*b*, 37*c* is circulated by the pump 60*a*, 60*b*, 60*c*. During the circulation, the cleaning liquid W passes through the filter 61*a*, 61*b*, 61*c*. The toner and other impurities floating in the conveyance passage are recovered by this filter, whereby the cleaning liquid in the conveyance passage is kept constantly to a specified cleanliness.

When the cleaning liquid in the unit is consumed as regeneration treatment of the recording medium proceeds and the liquid level L1 lowers to the position of the sensor S1, the sensor S1 sends a signal to make up the cleaning liquid from the make-up bottle 62 as required. In response to the signal the pump 64 is driven, so that the cleaning liquid is fed as required to each unit through the distributor 63.

The recording medium discharged from the post-cleaning unit 37*c* is then conveyed to the squeeze unit 32 in the outside of the maintenance tank 31 through the opening 36. In this squeeze unit 32, the excess cleaning liquid on the recording medium is squeezed and recovered in the reservoir 67. The recovered cleaning liquid is then sent to the make-up bottle 62 through the cleaner 69.

The recording medium having passed the squeeze unit 32 is then transported to the first dryer unit 33. The recording medium is dried with the heaters 70 and 71 while being transported in the form of U letter.

The recording medium having passed the first dryer unit 33 is transported to the second dryer unit 34. In this dryer unit 34, the recording unit is pressed by the roller pair 74, 75 and dried with the heaters contained therein. In addition, allowing the recording medium to pass between these rollers can repair fine defects on the recording medium surface given during printed letter treatment or fine scratches caused by staplers, etc. or straighten bends, etc. to a certain extent. In addition, in the case of paper, it can be polished with this treatment.

The recording medium after drying is discharged outside of the regenerating unit 3 through the discharge outlet 16, thereby completing a series of regenerating treatment operation.

The regenerating apparatus according to this invention comprises a removably mounted cleaning unit for removing the printing material. Therefore, it enables easy maintenance such as removal of floating printing material in the regenerating apparatus or cleaning or replacement of the printed letter removing means and prevents degradation of the cleaning effect to the maximum according to the repetition of usage. In addition, it is possible to simultaneously remove a written portion with a ballpoint pen, fluorescent pen, magic marker or pencil, or a stamped portion with vermilion as well as a printing portion by selecting a cleaning liquid suitably.

2. Regenerating unit

Referring now to FIGS. 8–11, embodiments of the regenerating unit according to the present invention will be described in detail hereinafter. This regenerating unit can be replaced with the regenerating unit 3, particularly with the cleaning units 37*a*–37*b* of the regenerating apparatus 1 described above as shown in FIGS. 1–7.

Figure 8:
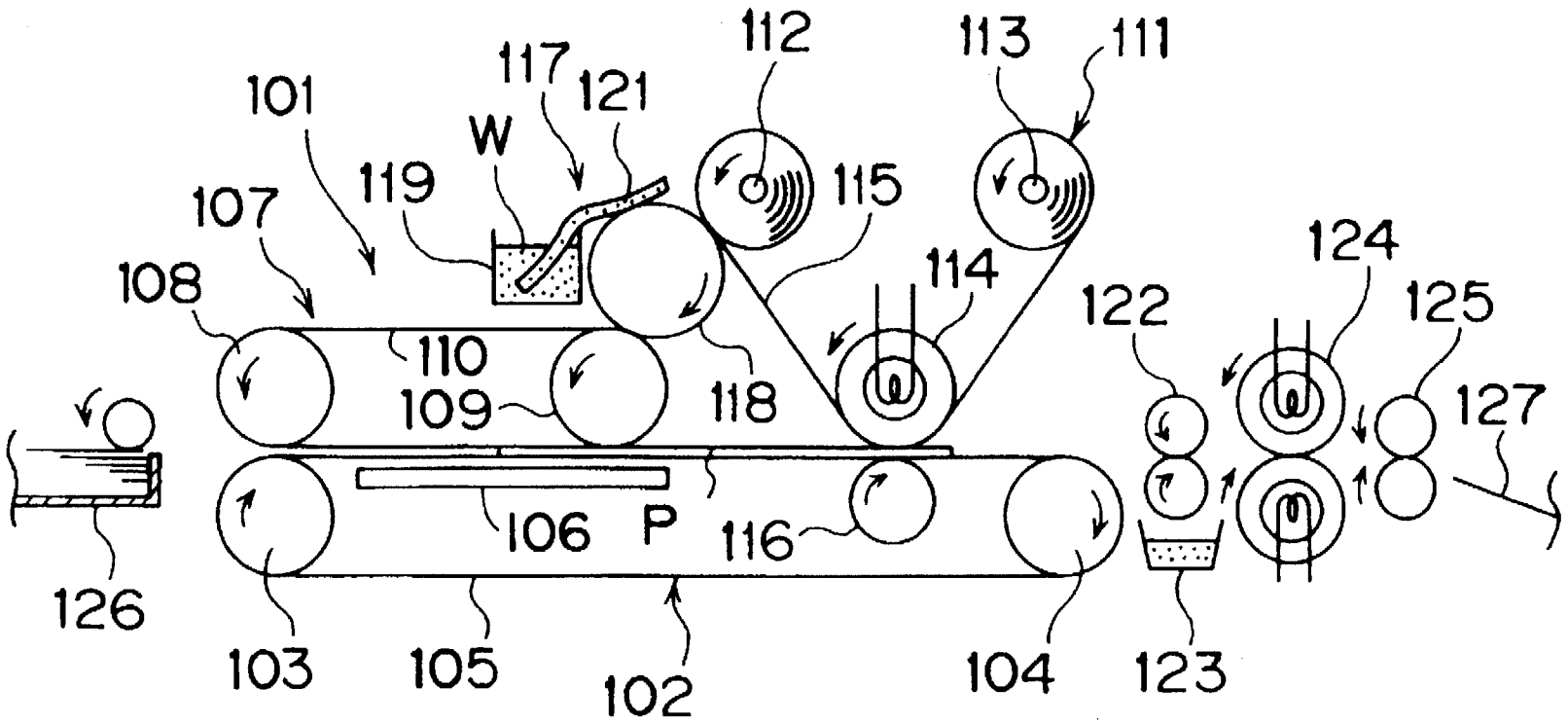
FIG. 8 is a schematic sectional view of the first embodiment of the regenerating unit according to the present invention.

FIG. 8 shows a regenerating unit 101 according to the first embodiment of the invention.

This regenerating unit 101 is constituted by a conveyor 102, a pre-applicator 107, a web type cleaning unit 111, a cleaning liquid feeder 117, a squeezing roller pair 122, a heater roller pair 124, and a calender roll 125.

The conveyor 102 is arranged to convey a recording medium P such as paper or OHP film. The conveyor 102 comprises rollers 103, 104 spaced in a pre-determined distance and arranged in parallel on the same horizontal plane and a belt 105 wrapped around these rollers.

In the inside of the belt 105, a heater 106 for preheating the recording medium conveyed on the belt 105 is arranged.

The pre-applicator 107 is arranged to apply a cleaning liquid initially to the top surface of the recording medium conveyed by the conveyor 102. The pre-applicator 107 comprises rollers 108, 109 which are arranged in parallel to the rollers 103, 104 and spaced in a predetermined distance on the same horizontal plane, and a applicator belt 110 wrapped around the rollers 108, 109. The applicator belt 110 that moves along the bottom edge of the rollers 108, 109 is designed to come in contact with the belt 105 that moves along the top edge of the rollers 103, 104.

The web type cleaning unit 111 is arranged to apply the cleaning liquid to the top surface of the recording medium conveyed by the belt 105 to remove the printing material such as toner which is swollen by the cleaning liquid. The cleaning unit 111 comprises a web feed roll 112, a web take-up roll 113, and a heater roller 114 with a built-in heater which comes in contact with the belt 105, all arranged in parallel to the rollers 103, 104 and located above the belt 105. The cleaning unit 111 further comprises a web 115 wrapped around the feed roll 112 with its one end fixed to the take-up roll 113 via the circumference of the heater roll 114 and a back-up roller 116 that is located inside the belt 105, energizes the belt to the heater roller 114 and brings it in contact with the heater roller. The web 115 is preferably a cloth or unwoven fabric cloth with excellent water absorbing capacity. The fiber composing these should preferably provide excellent heat resistance, chemical resistance, and flame tightness, and for example, Teijin Cornex (commercially available from Teijin Ltd.) is suitable.

The cleaning liquid feeder 117 is arranged to feed the cleaning liquid W to the applicator belt 110 and the web 115. The cleaning liquid feeder 117 comprises an applicator roller 118 in contact with both the applicator belt 110 and the web 115, a container 119 storing the cleaning liquid W, and a felt 121 which is a means for supplying the cleaning liquid to the circumferential surface of the applicator roller 118 based on the capillary phenomenon. The cleaning liquid W will be described in detail later.

The cleaning liquid feed rate of the feeder 117 should be set so as to feed about 5–6 cc of the cleaning liquid for one piece of A4 paper, considering that about 3 cc of the cleaning liquid is required for removing the printing material from one piece of A4 paper and that about 50% of the cleaning liquid fed to the applicator belt 110 and the web 115 is transferred to the recording medium P. However, in the case of the OHP film, 1–2 cc of the cleaning liquid is enough for one piece of A4 size. Consequently, it is desirable to design the feeder to accommodate automatic or manual adjustment of the application rate of the cleaning liquid in accordance with the types of the recording medium P (paper, OH film, etc.).

The squeezing roller pair 122 is arranged to squeeze out the cleaning liquid from the recording medium with the printing material removed. Preferably, the outer circumferences of the squeezing roller pair 122 is covered with elastic material such as silicon rubber, etc. The squeezing roller pair 122 is arranged adjacent and in parallel to the roller 104. Below the squeezing roller pair 122, a storage vessel 123 for the squeezed out cleaning liquid is located.

The heater roller pair 124 for heating and drying the recording medium is arranged to heat the moistened recording medium and dry to the recyclable condition. The heater roller pair 124 comprises a pair of rollers with built-in heaters and is arranged adjacent to the squeezing roller pair 122.

The calendar roll 125 is arranged to polish the dried recording medium and is arranged adjacent to the heater roller pair 124. In FIG. 8, numeral 126 is a feeder which stores the unprocessed recording medium and feeds them to the conveyor 102, and numeral 127 is a tray which stores the recording medium passing the calendar roll 125.

Now, the operation of the regenerating unit 101 constructed as described above will be discussed.

At the conveyor 102, the rotation of the rollers 103, 104 causes the belt 105 to move clockwise. At the pre-applicator 107, the rotation of the rollers 108, 109 causes the applicator belt 110 to move counterclockwise. Based on the motion of the belt 110, the applicator roller 118 rotates clockwise. The cleaning liquid W is applied on the circumference surface of the applicator roller 118 by the felt 121 and then transferred to the applicator belt 110 and the web 115 paid off from the feeder roll 112 to be impregnated therein. At the cleaning unit 111, the web 115 moves by the counterclockwise rotation of the take-up roll 113. The moving speed of the web 115 is preferably designed to be slower than the moving speed of the recording medium P and to provide a relative speed difference of 5 mm/sec of more with the speed of the recording medium P.

Consequently, the recording medium P delivered by the feeder 126 is introduced into the clearance between belts 105 and 110 at the intervals between rollers 103 and 108. As the recording medium P is conveyed to the right direction in the figure being held between the belt 105 and 110, the cleaning liquid W impregnated in the applicator belt 110 is applied to the recording medium P. The recording medium P is heated by the heater 106 to swell the printing material.

Then, the recording medium P comes in contact with the web 115 wrapped around the heater roller 114, is again applied with the cleaning liquid W impregnated in the web 115, and is given heat by the heater roller 114. As a result, the printing material adhering to the recording medium P further swells and is scraped off by the web 115.

The recording medium P with the printing material removed is fed from the conveyor 102 to the squeezing roller pair 122, where the cleaning liquid W is squeezed out, dried with the heater roller pair 124 to the recyclable condition, polished by the calendar roll 125, and discharged to the tray 127. The cleaning liquid W squeezed out by the squeezing roller pair 122 is received by the storage vessel 123.

In the meantime, the web 115 to which the printing material is transferred from the recording medium moves in accordance with the counterclockwise rotation of the take-up roll 113. Consequently, to the recording medium P, a web free from stains constantly comes in contact and a required volume of the cleaning liquid W is fed. When the web 115 of the feeder roll 112 runs out, it is replaced with a new roll. This is a simple operation to only replace the roll.

The replacement of the roll becomes simpler operation by constituting the feeder roll 112, the take-up roll 113 and the heater roller 114 as a united unit.

In this embodiment, the cleaning liquid feeder 117 applies the cleaning liquid to both the applicator belt 110 and the web 115, but it may apply the cleaning liquid only to the applicator belt 110.

Figure 9:
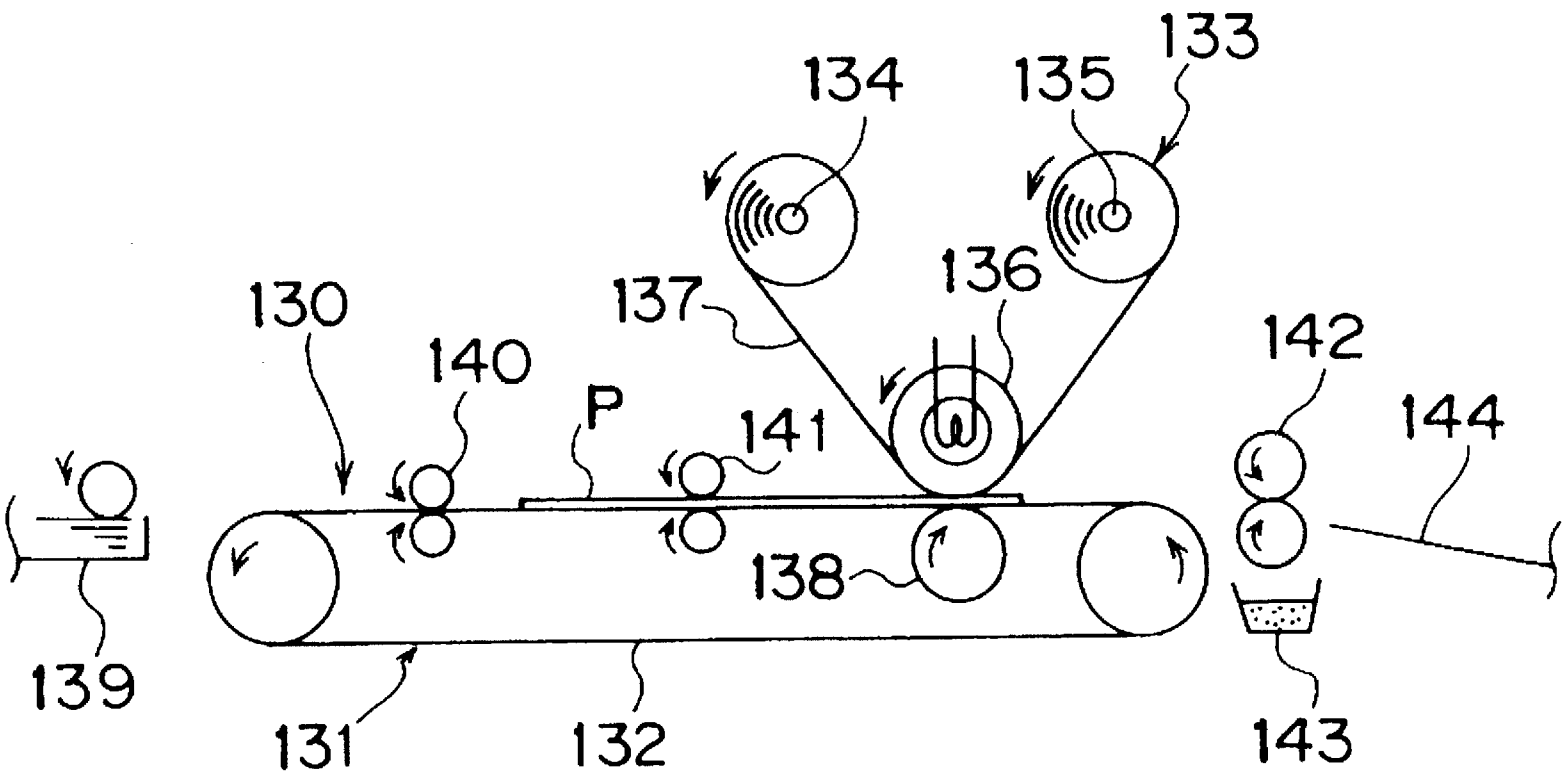
FIG. 9 is a schematic sectional view of the second embodiment of the regenerating unit according to the present invention.

FIG. 9 shows a regenerating unit 130 according to the second embodiment of the invention.

This regenerating unit 130 comprises a conveyor 131 and a cleaning unit 133 as well as a feeder 139, squeezing roller pair 142, a container 143 and a tray 144. The conveyor 131 has a belt 132 constituted in the same manner as the conveyor 102 of the first embodiment in FIG. 8 except roller pairs 140, 141 which pinch the recording medium P on the belt 132. The cleaning unit 133 comprises a feeder roll 134, a take-up roll 135, heater roller 136, a web 137, and a backup roller 138, these are constituted in the same manner as the cleaning unit of first embodiment in FIG. 8 except the web 137.

The web 137 of the cleaning unit 133 wrapped around the feeder roll 134 is already impregnated with the cleaning liquid. Consequently, when the recording medium P fed by the feeder 139 moves to the section opposite to the heater roller 136 and the backup roller 138 via the roller pair 140, 141 by the belt 132 of the conveyor 131, it comes in contact with the web 137 paid off from the feeder roll 134 to swell the printing material. After the printing material is removed in cooperation with the heat given by the heater roll 136, it is squeezed with the squeezing roller pair 142 to remove the cleaning liquid and discharged to the tray 144. The web 137 with the printing material transferred is taken up around the take-up roll 135. In addition, the cleaning liquid squeezed out by the squeezing roller pair 142 is recovered into the container 143.

Figure 10:
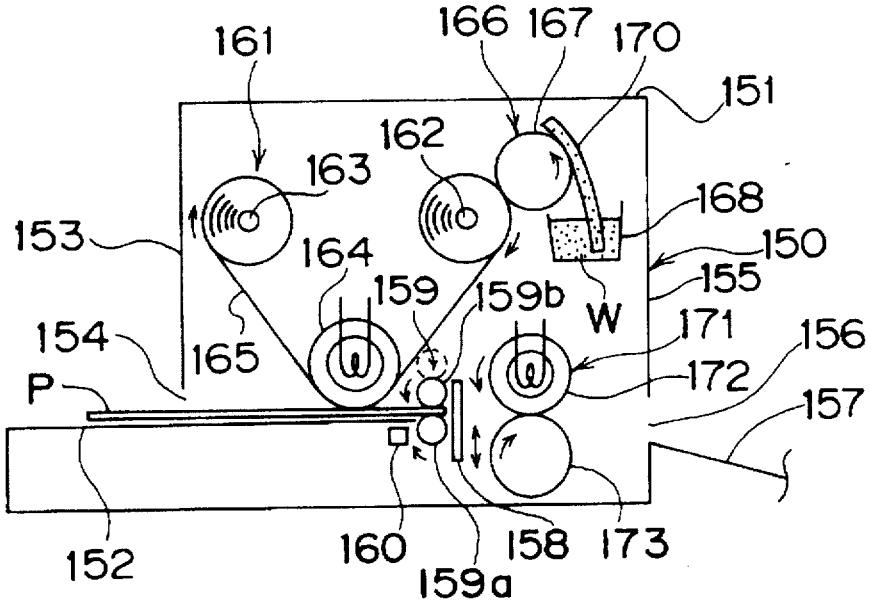
FIG. 10 is a schematic sectional view of the third embodiment of the regenerating unit according to the present invention.

FIG. 10 shows a regenerating unit 150 according to the third embodiment of the invention.

This regenerating unit 150 has a housing 151. At the lower left of the housing 151, a recording medium charging table 152 is installed. Below the lower end of the side wall 153 of the housing 151, a recording medium charging port 154 is formed. On the opposite side wall 155 of the housing 151, a recording medium discharge port 156 is formed and a discharge tray 157 are installed.

Ahead of the charging table 152, a stopper 158 which protrudes and evacuates on the extension of the top surface of the charging table 152 is installed. At the head end of the charging table 152, a roller pair 159 comprising a lower roller **159*a* and an upper roller 159*b* which comes in contact with and separates from the lower roller, and a sensor 160 for detecting the recording medium are charged. When the unit 150 is not in operation, the stopper 158 protrudes to the extension of the charging table 152 and the upper roller 159b** evacuates upwards (dotted-line position).

In the inside of the housing, there is provided a cleaning unit 161, a cleaning liquid applicator 166, and a heater dryer 171.

The cleaning unit 161 comprises a web feeder roll 162, a web take-up roll 163, a built-in heater type heater roller 164 which comes in contact with and separates from the charging table 152, and a water-absorbent web 165 composed of unwoven fabric cloth, etc. which is taken up around the take-up roll 163 via the heater roller 164 from the feeder roll 162. When the regenerating apparatus 150 is not in operation, the heater roller 164 separates from the charging table 152.

The cleaning liquid applicator 166 comprises an applicator roller 167 in contact with the web 165 wrapped around the take-up roll 162, a container 168 storing the cleaning liquid, and a felt 170 for applying the cleaning liquid W to the circumferential surface of the applicator roller 167.

The heater dryer 171 is composed with a built-in heater type heating roller 172 and a roller 173 in pressure-contact with the heating roller 172.

In the regenerating unit 150 constructed as described above, the cleaning liquid W is transferred to the web 165 paid off from the feeder roller 162 and impregnated after it is applied to the circumferential surface of the applicator roller 167 via felt 170. The recording medium P is charged from the charging port 154 along the charging table 152 and is positioned by bringing the tip end in contact with the stopper 158. When the sensor 160 detects that the recording medium P is charged, the upper roller 159b descends to hold the tip end of the recording medium P together with the lower roller 159a. At the same time, the heating roller 164 descends to press the web 165 impregnated with the cleaning liquid W against the recording medium P. Then, the stopper 158 evacuates from the extension of the charging table 152 and the rollers 159a, 159b rotate in the arrow directions, respectively, to convey the recording medium P to the discharge side (right side in the figure). This causes the recording medium P to slidably come in contact with the web 165 and the cleaning liquid W impregnated in the web 165 is applied, and together with the heat given by the heating roller 164, the printing material swells and is scraped off by the web 165. The recording medium P with the printing material removed is then heated and dried by the heater 171 and discharged to the tray 157 via the discharge port 156.

In this embodiment, the cleaning liquid applicator 166 is mounted to impregnate the web 165 with the cleaning liquid W, but as described in the second embodiment, it is possible to use the web 165 which is impregnated with the cleaning liquid previously.

Figure 11:
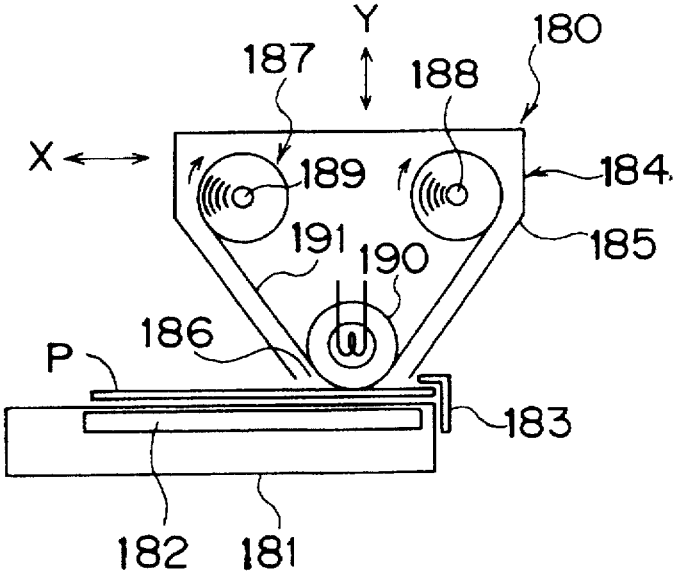
FIG. 11 a schematic sectional view of the fourth embodiment of the regenerating unit according to the present invention.

FIG. 11 shows a regenerating unit 180 according to the forth embodiment of the invention.

This regenerating unit 180 comprises a box-type recording medium transfer table 181 and a cleaning unit 184.

The transfer table 181 houses a heater 182. On one end of the table 181, a chuck 183 for holding a recording medium P loaded on the table 181 is mounted. The cleaning unit 184 has a housing 185 which moves horizontally (X arrow direction) and vertically (Y arrow direction). At the bottom of the housing 185, an opening 186 is formed. In the inside of the housing 185, a cleaning unit 187 is provided. The cleaning unit 187 comprise a web feeder roll 188, a web take-up roll 189, a built-in heater type heating roller 190 located at the opening 186, and a water-absorbent web 191 composed of cloth or unwoven fabric cloth wrapped around the feeder roll 188 with its tip end fixed to the take-up roll 189 via the heating roller 190. This web 191 is impregnated with the cleaning liquid.

In this regenerating unit 180, the recording medium P is loaded on the table 181, with the cleaning unit 184 located above one end of the table 181, and one end of the recording medium P is fixed with the chuck 183. Then, the cleaning unit 184 is lowered to bring the web 191 in contact with the recording medium P. In the meantime, while the web 191 is being taken up around the take-up roll 189, the cleaning unit 184 is moved horizontally. This causes the printing material of the recording medium P to be swollen with the cleaning liquid and scraped off with the web 191.

In this regenerating unit 180, the web 191 is impregnated with the cleaning liquid from the beginning, but as described in the first and third embodiments, a cleaning liquid applicator may be installed to impregnate the web with the cleaning liquid.

In the above-mentioned regenerating apparatus, when the web containing the cleaning liquid comes in contact with the recording medium, the printing material swells and this swollen printing material is removed with the web. The web with the printing material attached is sent out from the contact section of the recording medium with a feeding means. Consequently, a clean web is constantly in contact with the recording medium and conversely, there is no fear for transferring the printing material attached to the web to the recording medium again. In this way, according to this invention, no accessories such as a cleaning unit is required and the regenerating apparatus can be downsized.

3. Image forming equipment with regenerating apparatus

Referring now to FIGS. 12–17, embodiments of the image forming equipment with regenerating apparatus according to the present invention will be described in detail hereinafter.

Figure 12:
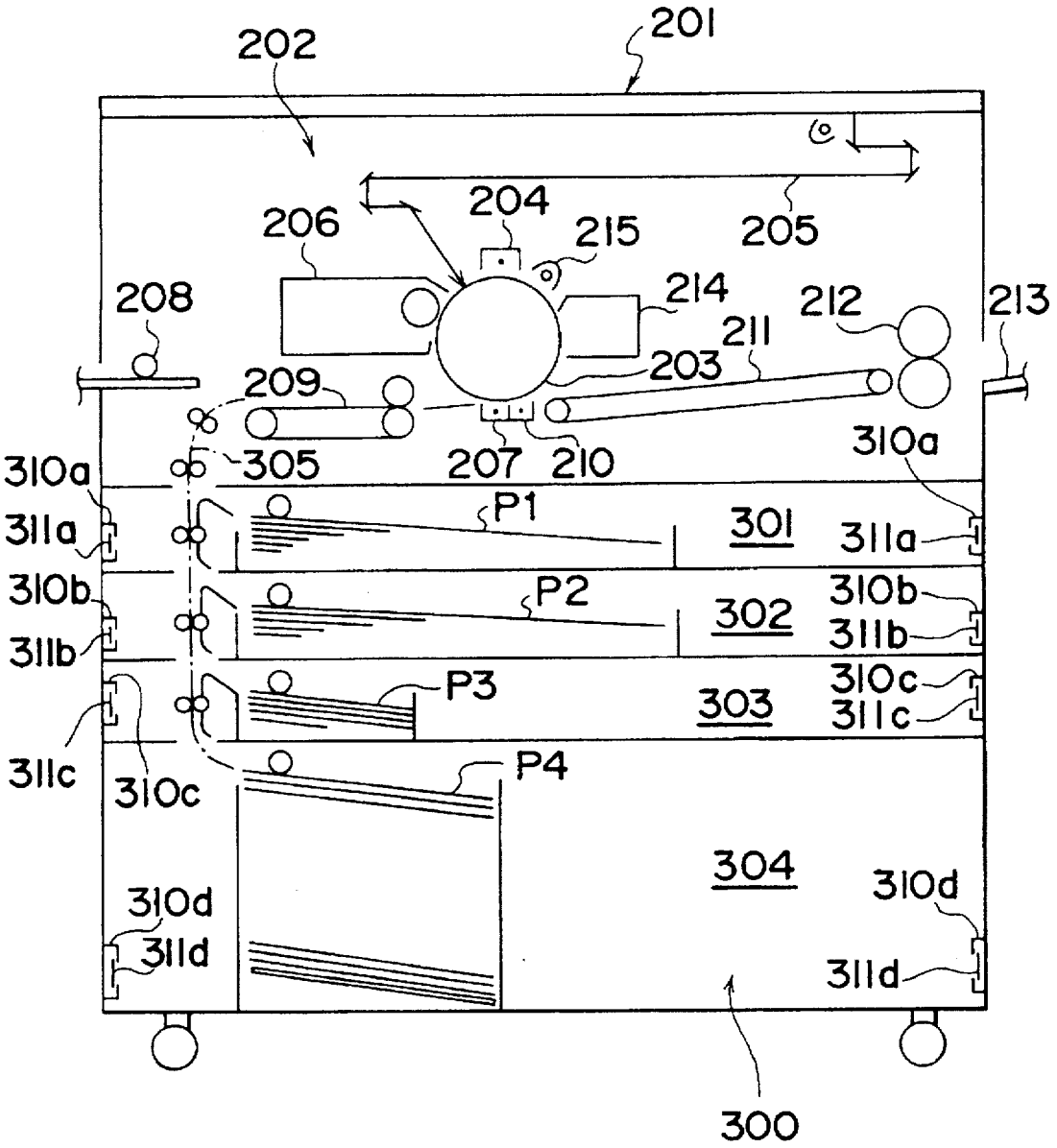
FIG. 12 is a sectional view of a copier according to the invention.

FIG. 12 shows a copier 201, one of the form of the image formers. This copier 201 generally comprises an image forming section 202 that forms images by allowing the toner, the printing material, to adhere to a recording medium such as paper or OHP film and a recording medium feeding section 300 that feeds recording medium P1–P4 to this image forming section 202.

The image forming section 202 is equipped with all the necessary devices to form images by electrophotography, that is, a photosensitive body 203, a charger 204 for charging a circumferential photosensitive layer of the photosensitive body 203, an optical device 205 for forming electrostatic latent images by irradiating the original image on the charged photosensitive layer, a developing device 206 which brings the developer containing a toner in contact with the photosensitive layer and visualizes the said electrostatic latent images as toner images, a transfer device 207 for transferring the toner images to the recording medium fed by the recording medium feeder 208 via a conveyor 209, a separating device 210 which separates the recording medium with toner images adhered from the photosensitive body 203, a conveyor 211 which conveys the recording medium separated from the photosensitive body 203 to the discharge side, a fixing device 212 which fixes the toner images on the recording medium delivered by the conveyor 211, a discharger 213 which discharges the recording medium passing the fixing device 212, a cleaning unit 214 which removes the toner, etc. remaining on the photosensitive body 203 without being transferred to the recording medium, and an eraser 215 which removes charges remaining on the photosensitive body 203 after the residual toner is removed. The general construction and operation of these devices are known and the explanation on these devices is omitted.

The recording medium feeding section 300 is equipped with a plurality of feeders 301, 302, 303, 304 arranged at the top and the bottom, and is designed to feed the recording medium P1, P2, P3, P4 stored in each feeder 301, 302, 303, 304 onto the recording medium conveyance passage of the image forming section 202 by conveyor 305, respectively. These feeders 301–304 are designed to be removable from the copier 201, respectively, and after removing the feeders 302, 303, 304 on the lower 3 layers, a regenerating apparatus 400 can be mounted as illustrated in FIG. 2.

Figure 13:
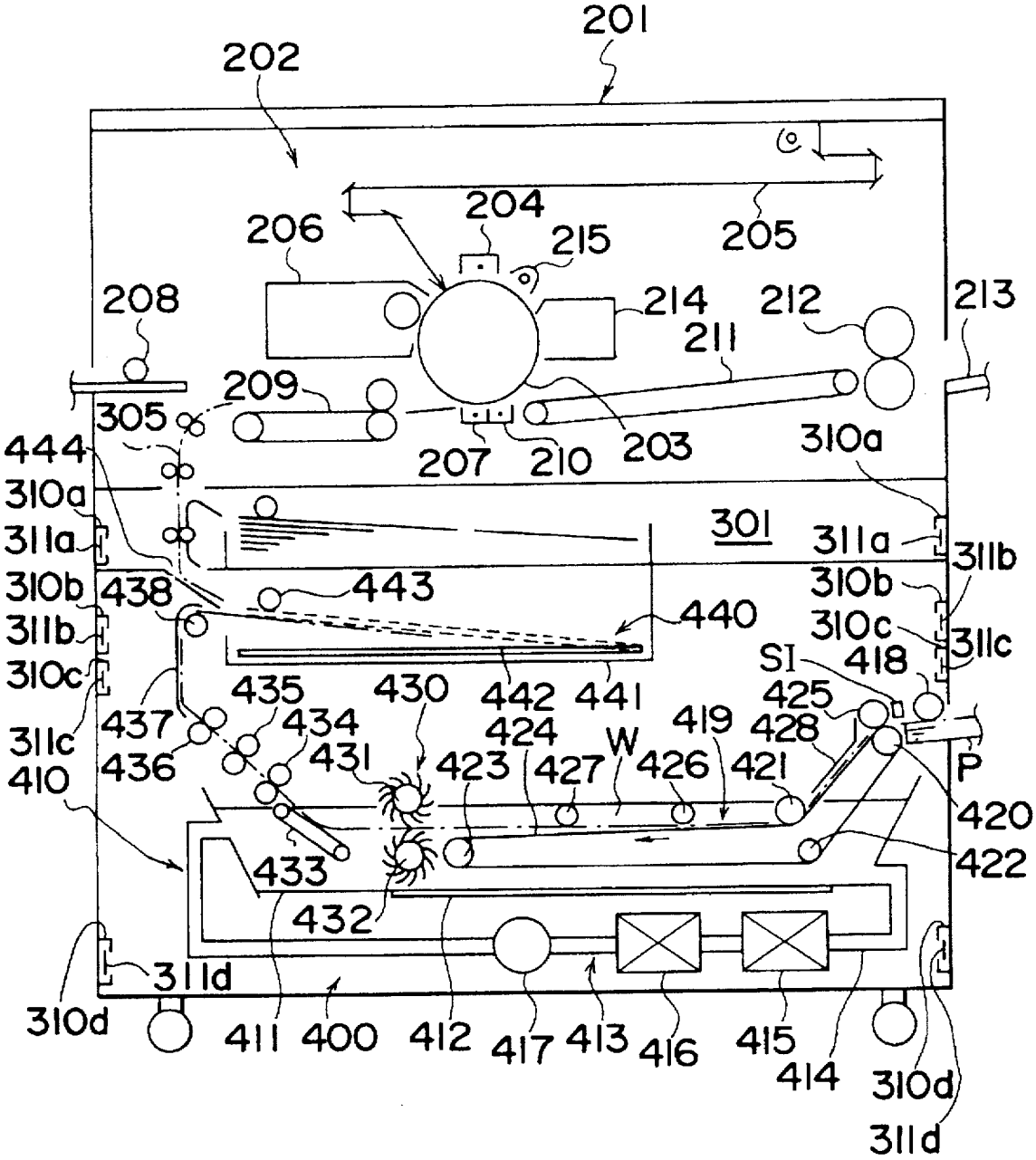
FIG. 13 is a sectional view of a copier with regenerating apparatus according to the invention.
Figure 14:
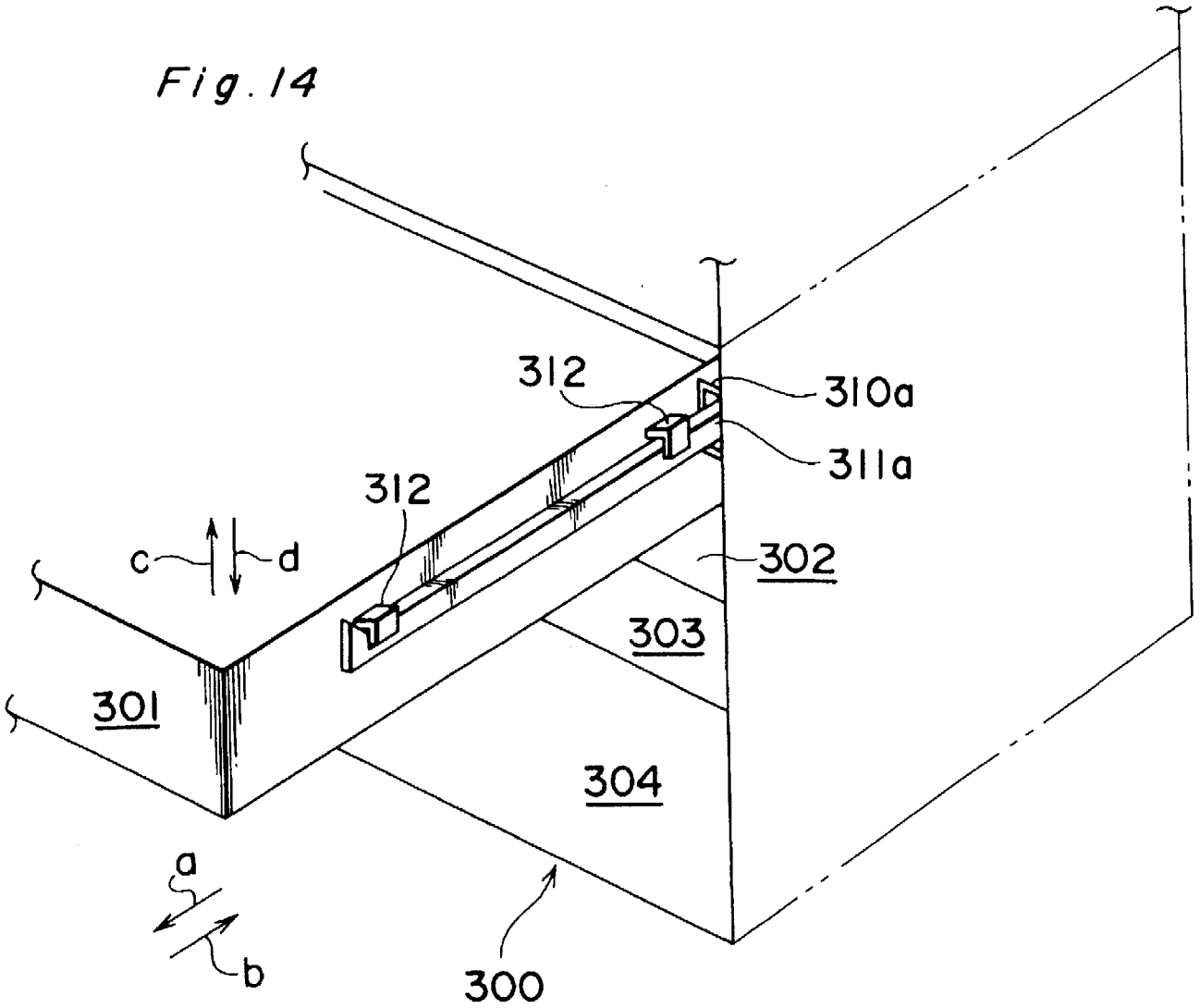
FIG. 14 is a fragmental perspective view of the copier illustrated in FIG. 12.
Figure 15:
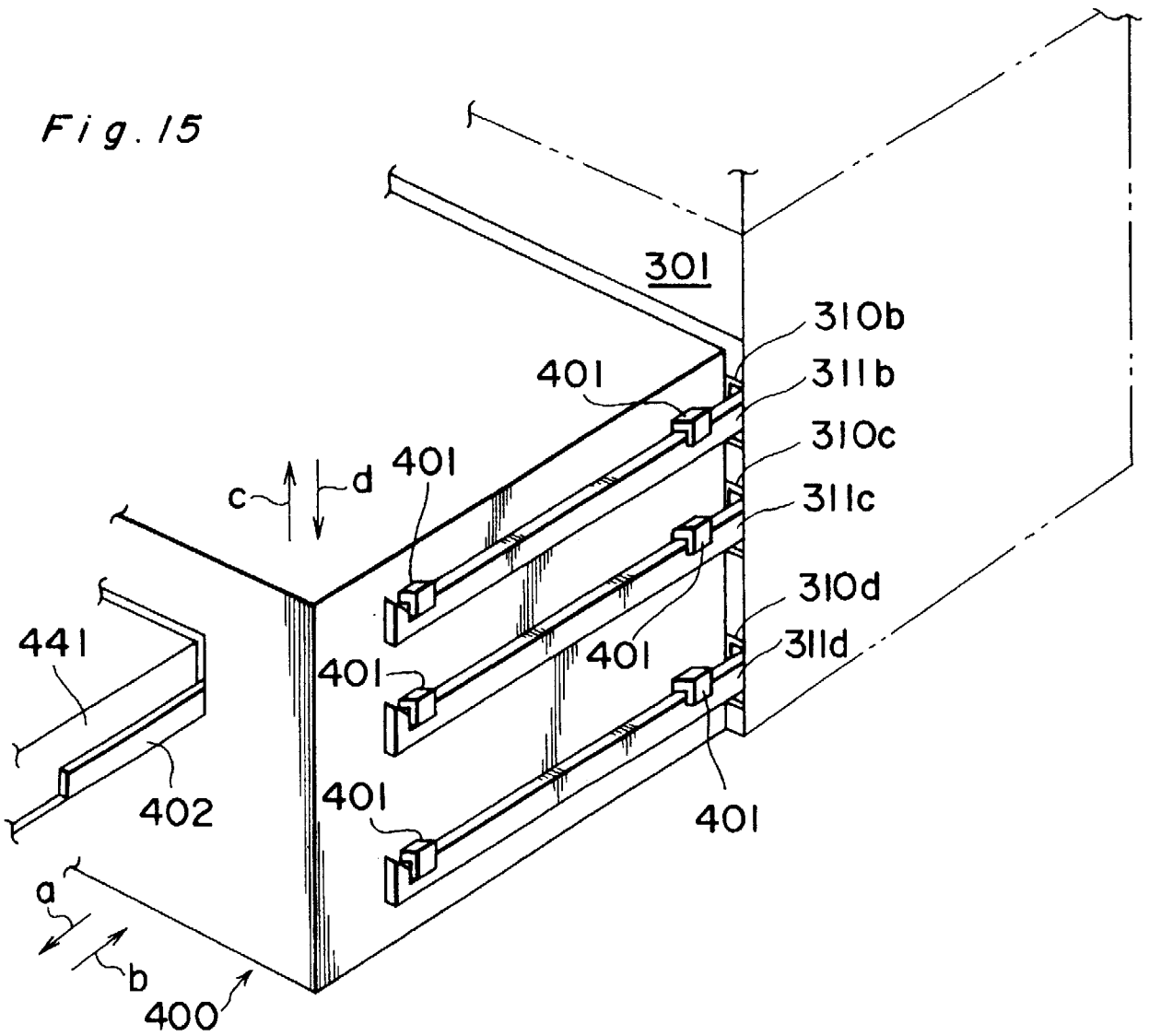
FIG. 15 is a fragmental perspective view of the copier with regenerating apparatus illustrated in FIG. 13.

On this point, description is made in further detail using FIGS. 14, 15 in addition to FIGS. 12, 13. As shown in FIGS. 12, 14, the feeders 301–304 are designed to be movable in arrow (a), (b) directions between the position where they are housed inside the copier 201 and the position protruding from the inside by the guide rails 310*a*–310*d* fixed to the copier 201 and sliding guides 311*a*–311*d*.

To the feeders 301–304, engaging protrusions 312 having a section of L-shape configuration which engage to the sliding guides 311*a*–311*d* are attached. FIG. 14 shows the engagement condition between the sliding guide 311*a* and engaging protrusions 312 with respect to the feeder 301. As clear from FIG. 14, pulling out the feeder 301 to the most protruded position from the copier 201 and then lifting it up in the arrow (c) direction enables the feeder 301 to be detached from the copier 201. This arrangement is also provided for feeders 302–304.

The copier 201 is able to be used as a conventional publicly known image former as shown in FIGS. 12, 14. In the meantime, the copier 201 is also designed to be able to accommodate the regenerating apparatus 400 as shown in FIGS. 13, 15 in case that the regeneration function is required at the users. That is, the feeders 301–304 are removed from the copier 201 and then the regenerating apparatus 400 is mounted to this position.

As shown in FIG. 15, the regenerating apparatus 400 is equipped with engaging protrusions 401 that engage the sliding guides 311*b*–311*d* used for the feeders 301–304. Lifting the regenerating apparatus 400 slightly in the (c) direction and pulling it out to this side of the regenerating apparatus 400, and then lifting it again in the (c) direction enables the regenerating apparatus 400 to be removed from the copier 201. Arranging the regenerating apparatus 400 in this way enables the installation of the regenerating apparatus 400 in place of feeders 301–302 as shown in FIGS. 12, 14 when the function of the copier only is required.

In addition, the regenerating apparatus 400 is not fixed to the copier 201 but is removably mounted, ensuring extremely easy maintenance. The regenerating apparatus 400 cannot avoid accumulation or stains of the cleaned toner or deterioration by time of the cleaner 430 later discussed. This requires cleaning or replacement of the element such as cleaner 430, etc. If the regenerating apparatus is fixed, quick maintenance would be difficult.

However, since the regenerating apparatus 400 is designed to be removable as shown in the image former of the present invention, such regenerating apparatus not only provides advantage of easy maintenance but also achieves practically maintenance-free operation if the regenerating apparatus 400 requiring maintenance is replaced with a new regenerating apparatus and while this new regenerating apparatus is being used, the removed regenerating apparatus 400 is maintained and after completion of maintenance, the new regenerating apparatus is replaced with the maintained regenerating apparatus 400 again.

The above embodiment is designed for the feeders 301–302 to be replaceable with the regenerating apparatus 400 but the design in which the regenerating apparatus 400 is removably mounted to the copier 201 is not limited to this. That is, it is possible to design for only one feeder, for example, feeder 302, to be replaceable with the regenerating apparatus 400. It is also possible to provide a portion to which the regenerating apparatus 400 can be mounted previously in the copier 201 completely separately from feeders 302–304. When the regenerating apparatus 400 is not mounted to the copier 201, the portion for accommodating the regenerating apparatus 400 remains as a dead space, but the functions original to the copier are not subjected to any restriction. In addition, needless to say, the removable mechanism is not limited only to a combination of the sliding guides 311*b*–311*d* and the engaging protrusions 312, 401 as shown in the above embodiment.

For example, sliding guides 311*b*–311*d* may be omitted and a convex guide set and a concave which engage each other may be simply provided on the copier 201 and the regenerating apparatus 400. In short, it is important that the regenerating apparatus 400 is not fixed to the image former such as a copier 201, etc. and both the copier 201 and the regenerating apparatus 400 are arranged so that the regenerating apparatus 400 is removable from the copier 201.

The regenerating apparatus 400 generally stores a cleaning unit 410 for removing a printing material adhered to the recording medium to regenerate the recording medium into recyclable condition, and a secondary feeder 440 which stores the regenerated recording medium and feeds to the image forming section 202 as required. When the operator selects the regeneration mode on the operation panel not illustrated, the regenerated paper is automatically conveyed from the secondary feeder 440 to the image forming section 202 and normal copying operation takes place.

The cleaning unit 410 comprises a container 411, a cleaning liquid circulating device 413, a feeder 418, a conveyor 419, a cleaner 430, and a secondary conveyor 433.

The container 411 stores the cleaning liquid W (later discussed in detail) for swelling the printing material such as a toner, etc. On the bottom of the container 411, it is provided with a heater 412 for keeping the cleaning liquid W to proper temperature (specifically 10° C.).

The cleaning liquid circulating device 413 comprises a transportation pipe 414, both ends of which are connected to the container 411 respectively, a first filter 415, a second filter 416, and a pump 417 as a liquid circulating means connected in series to this transportation pipe 414. The first filter 415 removes printing material particles floating in the cleaning liquid W, for example, toner particles, and is packed with glass wool, filter paper, polyester cloth, etc., while the second filter 416 is designed to remove dyes contained in the printing material and is filled with activated coal, molecular lubricant, etc.

The feeder 418 for storing the recording medium P to which the printing material has already adhered is mounted below the discharging device 213 which discharges the recording medium at the right in the figure, that is, at the image forming section 202. Consequently, the operator is able to feed a miscopy formed by the copier 201 immediately to the regenerating apparatus 400.

The conveyor 419 conveys the recording medium P fed from the feeder 418 to immerse it into the cleaning liquid W. The conveyor 419 comprises rollers 420, 421, 422, 423, a belt 424 supported by these rollers 420, 421, 422, 423, rollers 425, 426, 427 for guiding the recording medium P from the feeder 418 into the cleaning liquid W in cooperation with the belt 424, and a guide plate 428 for guiding the recording medium P between rollers 425 and 421.

The cleaner 430, for example, is composed of a pair of brush rollers 431, 432 located opposite to each other at the top and the bottom as illustrated and is designed to bring the brush tip end of brush rollers 431, 432 in contact with the front and the rear surfaces of the recording medium P introduced into the cleaning liquid W by conveyor 419, respectively, and to remove the swollen printing material from the recording medium P by the physical contact.

The secondary conveyor 433 comprises a belt wound around a plurality of rollers, and is designed to take out the recording medium P which has passed through the cleaner 430 from the cleaning liquid W. Above the secondary conveyor 433, there arranged are a squeezing roller pair 434 which holds the recording medium P taken out from the cleaning liquid W therebetween and squeezes out the cleaning liquid W, a heating roller pair 435 for heating and drying the wet recording medium P to a condition that allows recycling of the recording medium P, a calendar roll 436 which polishes the recording medium P, a guide plate 437 for guiding the recording medium P which has passed the calendar roll 436, and a roller 438 which transports the recording medium P to the secondary feeder 440 in cooperation with this guide plate 437.

The secondary feeder 440 is designed to be pulled out by the guide 402 as shown in FIG. 15 and enable the removal of the regenerated paper as required.

The secondary feeder 440 has a recording medium storage container 441, installed at the bottom of which a is lift plate 442 which swings with one end (right end in the figure) as a fulcrum. Above the other end (left side in the figure) of the storage container 441, a feed roller 443 for discharging the recording medium lifted by a lift plate 442 and an opening 444 for guiding the recording medium P sent out from the storage container 441 to the conveyor 305 of the image forming section 202 are installed. In this embodiment, the regenerating apparatus 400 is designed to accommodate only one type of paper size but it may be designed to accommodate a plurality of paper sizes as shown in FIG. 16.

Figure 16:
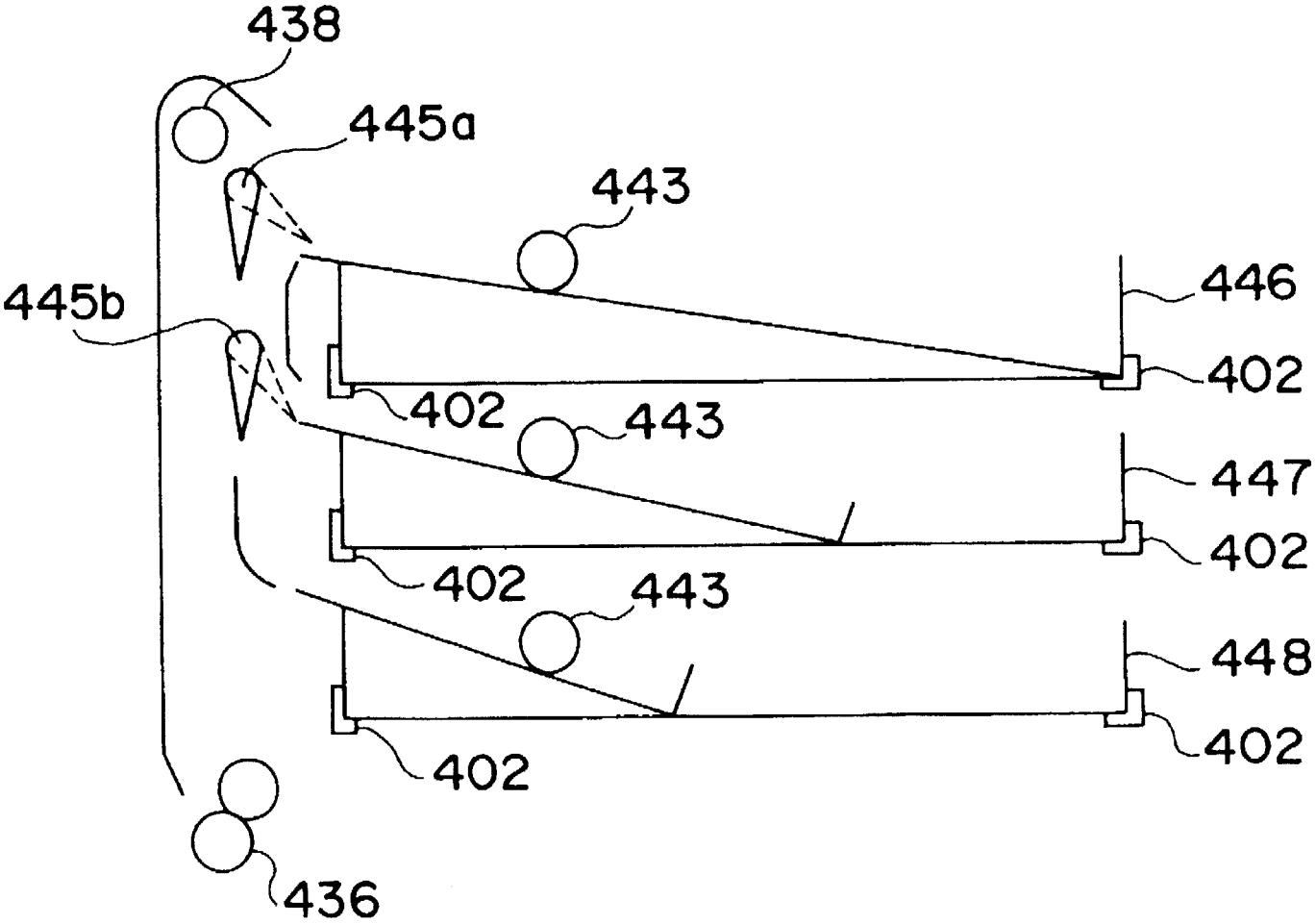
FIG. 16 is a sectional view of a modified example of a secondary feeder for the regenerating apparatus illustrated in FIG. 13.

FIG. 16 shows another modified example of the secondary feeder 440. That is, in this modified example, near the feeder 418 is mounted a sensor S1 (see FIG. 13) for detecting the time when the recording medium P passes this section to distinguish the paper size. There are provided three storage container 446, 447, 448 which contain different sizes of paper respectively, and two paper distribution pawls 445*a*, 445*b*. The paper distribution pawls 445*a*, 445*b* are designed to be moved between the solid-line position and the dotted-line position with a driving unit not illustrated based on the detection result of the sensor S1. For example, if the regenerated paper must be stored in the storage container 448 based on the detection result of the sensor S1, both paper distribution pawls 445*a* and 445*b* are evacuated to the solid-line position. If the sensor S1 detection result means to store the regenerated paper to the storage container 447, the paper distribution pawl 445*a* is evacuated to the solid-line position and the paper distribution pawl 445*b* is moved to the dotted-line position. If the regenerated paper is stored in the storage container 446, the paper distribution pawl 445*a* is moved to the dotted-line position.

In the above embodiment as shown in FIG. 13, the operator instructs to copy in the regeneration mode from the operation panel not illustrated, but in this modified case as shown in FIG. 16, it is designed to enable the operator to instruct not only the regeneration mode but also the regenerated paper size. After the instruction is given by the operator, the regenerated paper is automatically conveyed to the image forming section 202 by the rotation of the roller 443. In the above modified example, the storage containers 446–447 may be designed to accommodate, for example, a longitudinal feed of A3 size paper, longitudinal feed of B4 size paper, and lateral feed of A4 size paper.

However, in actuality, there is a case in which postcards or undefined size paper may be fed from the feeder 418. To cope with such case, it is practical to prepare a container for undefined sizes and to store all such papers in this container when the sensor S1 detects the paper of the size other than those previously set. In such event, feeding paper to the image forming section 202 from the storage container for the undefined sizes will complicate the mechanism of the storage container. Consequently, the operation panel has no mode for indicating the automatic paper feed from the undefined size storage container. Therefore, the operator must taken out the regenerated paper accumulated in the undefined size storage container as required, but even these undefined size papers can be recycled using a plurality of hand-feeding trays.

In the above regenerating apparatus 400, the recording medium P to be regenerated is stored in the feeder 418. The recording medium P fed from the feeder 418 is guided by the guide plate 428 in accordance with the operation of the rollers 420–423 and the belt 424 of the conveyor 419 and is immersed in the cleaning liquid W, and is conveyed in this cleaning liquid W to the left side direction in the figure. During the transportation, the printing material such as toner adhering to the recording medium P comes in contact with the cleaning liquid W and is swollen to the condition as to be readily removed by applying physical force. Next, the recording medium P comes in contact with the brush rollers 431, 432 when passing between brush rollers 431, 432 of the cleaner 430, and has the swollen printing material on the front and the rear surfaces scraped off. Then, the recording medium P is taken out from the cleaning liquid W by the secondary conveyor 433, has the cleaning liquid W squeezed out with the squeezing roller pair 434, is heated and dried to the recyclable condition by the heating roller pair 435, has wrinkles stretched with the calendar roll 436 as well as polished, and is delivered into the storage container 441 of the secondary feeder 440 by the guide plate 437 and roller 438.

The cleaning liquid circulating device 413 circulates the cleaning liquid W stored in the storage vessel 411 through the transportation pipe 414 in accordance with the drive of the pump 417. The cleaning liquid W transported in the transportation pipe 414 is first removed of the printing material, for example, toner particles, at the first filter 415 and then dyes of the printing material at the second filter 416. Consequently, the cleaning liquid W in the storage vessel 41 is kept constantly clean.

At the secondary feeder 440, the lift plate 442 is at the lowering position as shown with a solid line when the recording medium P is charged, and the charged recording medium P is accumulated on the lift plate 441. When the recording medium P is fed from the secondary feeder 440 to form images on it, the lift plate 442 ascends to press the recording medium P loaded on the plate against the roller 443. The recording medium P is fed to the conveyor 305 of the image forming section 202 via the opening 444 in accordance with the rotation of the roller 443 and has the image formed in accordance with the image forming operation described above.

Figure 17:
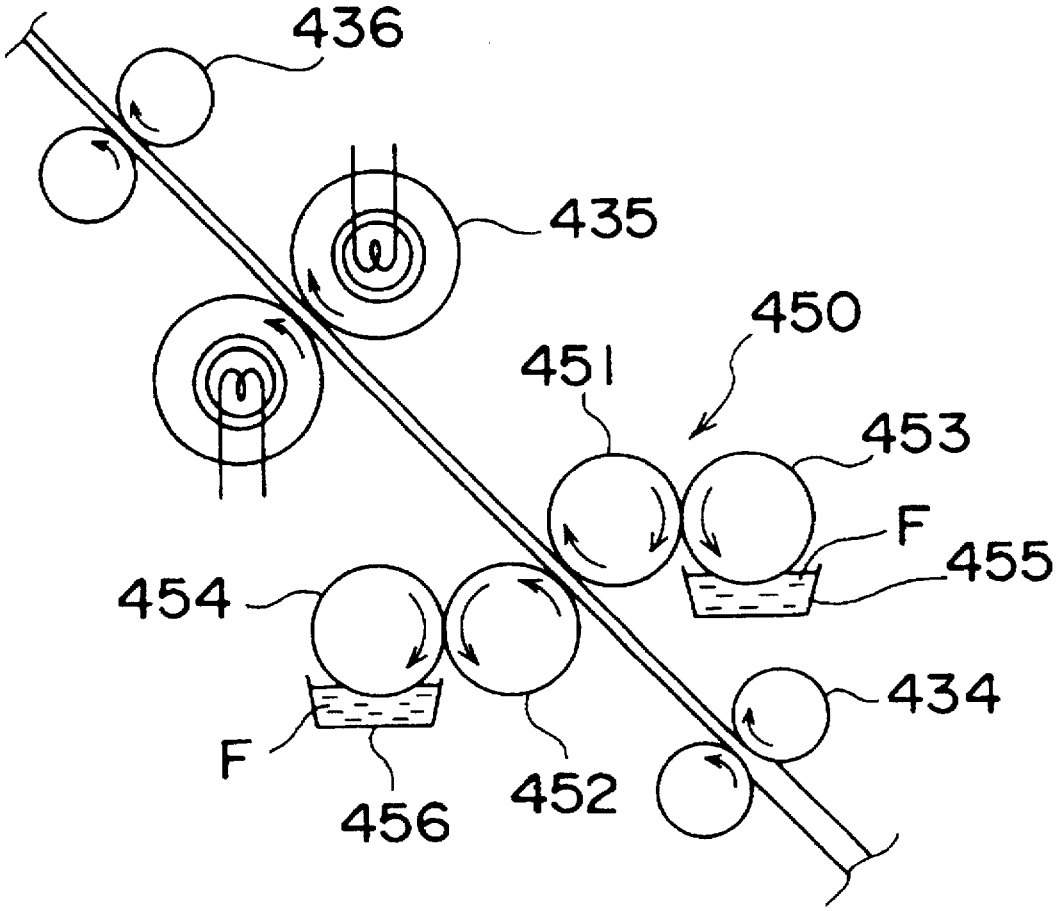
FIG. 17 is a sectional view of a paper strength enhancing device for the regenerating apparatus illustrated in FIG. 13.

In the said regenerating apparatus 400, it is desirable to install a paper strength enhancing device 450 between the squeezing roller 434 and the heating roller 435 as shown in FIG. 17 to provide strength particularly to the regenerated paper. The paper strength enhancing device 450 is provided with a pair of transfer rollers 451, 452 in contact with the front and the rear surfaces of the recording medium P, respectively, and application rollers 453, 454 which come in contact with the transfer rollers 451, 452 respectively, and feed a paper strength enhancing agent F stored in containers 455, 456 to each transfer roller 451, 452. Consequently, the paper strength enhancing agent F stored in the containers 455, 456 is fed to the transfer rollers 451, 452, respectively, via the application rollers 453, 454 in accordance with the rotation of the application rollers 453, 454 and the transfer rollers 451, 452 driven by these rollers, and applied to the front and the rear surfaces of the recording medium P, respectively.

Examples of formulation of the paper power enhancing agent F are shown in Table 1 below.

TABLE 1

| Components | Mixing Ratio (wt %) |
|---|---|
| Synthetic polymer type surface sizing agent | 0.1 |
| Starch | 5.0 |
| Others (Fluorescent, antifoamer, etc.) | traces |
| Water | remainder |
| Total | 100 |

In the above embodiment of the copier, instead of the regenerating apparatus 400, it is possible to use the regenerating unit 3 as shown in FIG. 2 or the regenerating unit 101, 130, 150, 180 as shown in FIGS. 8–11.

In the image forming equipment with a means to form images by allowing the printing material to adhere to the recording medium, since the regenerating apparatus for removing the printing material from the recording medium and discharging it in the recyclable condition is mounted removably to the image forming equipment, users who do not need the regenerating apparatus do not have to purchase the regenerating apparatus together with the image forming equipment, can enjoy cost advantages, and have an option to purchase the regenerating apparatus when the users need one in the future. The users who need the regenerating apparatus can purchase the regenerating apparatus alone, providing the users with a wider variety of selection. In addition, when the regenerating apparatus section is maintained, it is possible to quickly remove the regenerating apparatus or install a new regenerating apparatus. Consequently, convenience at the time of maintenance of the regenerating apparatus is greatly improved. In the image forming apparatus with the regenerating apparatus, the printed recording medium such as miscopies can be regenerated immediately by the regenerating apparatus, greatly saving paper.

4. Cleaning liquid and toner

The cleaning liquid will be described in detail. When the printed portion is removed without pulping the paper, extremely poor print removal effects are achieved by exerting the surfactant alone directly on the recording medium, and a substance that swells the toner is used together therewith to allow the toner to come up from the paper surface. Consequently, it is desirable to use the cleaning liquid that contains at least higher fatty acid ester, surfactant which has a compatibility with water and swells the printing material, and water. Water works to swell pulp fibers of the paper and efficiently remove the printing material, such as toner comprising resin particles which penetrate into the network structure. The water content is 10–90 wt % with respect to the total cleaning liquid, preferably, 20–88 wt %. However, when the water content is less than 1 wt %, there is a case in which effects to expand the fiber are not sufficient. Conversely, when the water content is excessively large, time required for cleaning greatly increases, lowering the cleaning treatment efficiency per unit time. Though it depends on the toner type, when water exceeds 90 wt %, the said time excessively increases and it is not desirable. If the water content is great as seen in this case, the bonding force (hydrogen bond) between fibers is weakened, damaging the paper surface during cleaning with physical force applied and in the extreme case, resulting in breaking the paper fiber to destroy the paper. It is, therefore, desirable to keep the water content to 30–85 wt %. When the cleaning liquid contains water, the boiling point rises as compared to that of the conventional organic solvent-based ink removing agent and volatility improves. With this effect, toxic gas generation decreases, toxicity lowers, inflammability lowers, stable concentration of other components of the cleaning liquid is achieved, and the quality is difficult to change.

For the swelling agent contained in the cleaning liquid, it is basically desired to have components that scarcely dissolve the resin component of the toner used in the developing device, dye component of the charge controlling agent, etc., and colorant component of pigments, etc., but primarily swell the resin component and convert the toner into gel-form plastic polymers. That is, the regenerating apparatus according to this invention is assumed to be subjected to the largest cleaning volume of the recording medium P prepared in the copier to which the regenerating apparatus is to be mounted. For the specific component, it is desirable to include those containing at least higher fatty acid ester, water, and surfactant, and in addition, organic acid.

Next, a discussion is made on the operation of this component. When the printed recording medium P is immersed in the cleaning liquid, the resin component of the toner fixed on the paper or OHP film adsorbs the swelling agent by the action of the said swelling agent and converts to viscous gel-form polymer with high plasticity which can stretch from 0.5 mm to several cm. This viscous gel-form polymer greatly lowers the bonding force to paper fibers or OHP film and is readily liberated only by applying a slight physical (mechanical) stress, and cleaning takes place. The cleaning action depends on the pH of the liquid and in particular, when the toner resin is polyester-based, bringing the liquid pH to weak alkaline of about 8–10 breaks the ester bonding to decompose into fine powders, enabling further easier removal. In addition, the cleaning action depends on the liquid temperature. Consequently, the liquid pH and temperature shall be determined based on these, but it is desirable to adjust the pH to 3.0–11.0 and liquid temperature in the range of 20°–60° C. In order to achieve stable cleaning effects, it is more desirable to use various pH buffers to keep the pH to an optimum constant value. Under the weak acidic condition with pH less than 3.0 or strong alkaline condition with pH exceeding 11.0, swelling action of toner resin by the swelling agent and peeling action are lowered. At the liquid temperature lower than 20° C., the speed of swelling action of the swelling agent lowers and it becomes difficult to achieve sufficient practical cleaning efficiency. In addition, when the liquid temperature exceeds 60° C., transpiration of the liquid is accelerated and heating power increases excessively, resulting in poor economy.

The fatty acid of the suitable higher fatty acid ester as a swelling agent must be saturated or unsaturated fatty acids and examples include lauric acid, myristic acid, palmitic acid, stearic acid, oleic acid, linoleic acid, erucic acid, ricinolic acid, abietic acid, rosin, coconut oil, linseed oil, beef tallow, whale oil, etc. Higher fatty acid ester is ester of the fatty acid and hydroxy compounds, examples of which include alcohols such as ethanol, n-butanol, etc., polyhydric alcohols such as ethylene glycol, glycerin pentaerythritol sorbitol, glycols such as diethylene glycol, dipropylene glycol, polyethylene glycol, etc., and cellosolves such as ethyl cellosolve, butyl cellosolve, etc., but particularly tall oil fatty acid ester is desirable.

Tall oil fatty acid contains oleic acid and linoleic acid at a ratio of about 6 to 4, as well as traces of palmitic acid, stearic acid, and unsaponifiable matter. Examples of alcohols which esterify tall oil fatty acid include ethylene glycol, polyethylene glycol, ethoxyethanol, butoxyethanol, etc., and preferably, butoxyethanol, ethylene glycol, and ethoxyethanol are used. The cleaning liquid of this invention preferably includes the surfactant. The surfactant serves to surround the organic component printing material such as cleaned resin component and prevents the cleaned printing material from re-adhering to the recording medium. Or when the recording medium is paper such as plain paper, the surfactant penetrates in the paper network structure to surround the printing material so that the printing material entering deep in the fiber is easily cleaned.

Examples of surfactants which are preferably added include anionic surfactant, nonionic surfactant, cationic surfactant, amphoteric surfactant, etc. Examples of anionic surfactants include fatty acid salts, alkylsulfate ester salts, alkyl benzensulfonic acid salts, alkyl naphthalene sufonates, alkyl suofosuccinic acid salts, alkyl diphenyl ether disulfonates, alkyl phosphates, polyoxyethylene alkylsulfate ester salts, naphthalene sulfonic acid formalin condensation products, poly carboxylic acid polymer surfactants, etc.

Examples of nonionic surfactants include polyoxyethylene alkylether, polyoxyethylene alkyl arylether, oxyethylene-oxypropylene copolymer, sorbitan fatty acid ester, polyoxyethylene sorbitan fatty acid ester, polyoxyethylene fatty acid ester, glycerol fatty acid ester, polyoxyethylene alkylamine, etc.

Examples of cationic and amphoteric surfactants include alkyl amine salts, quaternary ammonium salts, alkyl betaine, amine oxides, etc. Particularly preferable surfactants are ethylene oxide added type nonionic surfactants, which are expressed with the chemical formula: $RO(CH_2CH_2O)nH$ (R denotes $C_{12}$–$C_{22}$ alkyl group or alkyl phenyl group and n an integer of 1–10). The above surfactants can be used alone or as a mixture of two or more types. It is desirable to add 0.01–10 wt % (preferably, about 1–3 wt %) to the whole cleaning liquid. If it is less than 0.01 wt %, the removed toner is likely to re-adhere to the recording medium. If it is more than 10 wt %, bubbles are generated and it becomes difficult to handle.

The cleaning liquid preferably contains organic acid and must be penetrated in the printing material. The inventors of the present invention have found that the organic acid improves this penetration effects. And improved penetration effects can shorten the cleaning time. The organic acids preferably added are various carboxylic acids, such as simple substance or mixture of two or more types of formic acid, acetic acid, propionic acid, butyric acid, isobutyric acid, pivalic acid, methacrylic acid, acrylic acid, lactic acid, oxalic acid, tartaric acid, benzoic acid, etc. These organic acids are preferably added by 2–15 wt % to the whole cleaning liquid. If the content is less than 2 wt %, the ink removal speed may be slow and if it is more than 15 wt %, the remaining organic acid may work on the recording medium, causing deterioration in quality.

In the cleaning liquid, higher fatty acid ester should be used in the range of 60–5 wt %, preferably 40–20 wt % of the total cleaning liquid. If it is used more than 60 wt %, the solubility to the toner is high and it is likely to re-adhere to the paper, while if it is used in the range less than 5 wt %, the swellability to the toner degrades, resulting in poor cleaning effects.

The cleaning liquid may contain, within the range that would not impair the effects of the present invention, the organic solvent for swelling the toner, such as methanol, ethanol, n-butanol, isopropanol, ethoxyethanol, etc. and a mixture of these with xylene, toluene, aceton, THF, dioxane, dichloromethane, etc. Such cleaning liquid is commercially available from Nagamune Sangyo as TOSCLEAN D. TOSCLEAN D is a water-based detergent and is a light yellow transparent liquid with physical properties of acid number: about 2.1 mgKOH/g, specific gravity: 1.020 (20° C.), and pH: 7±0.5 (15° C.). This cleaning liquid does not contain any fluorine or carbon chloride compounds which are condemned for destroying the ozone layer, and can be used without deteriorating the earth environment. In addition, because it causes low toxicity to the human body and is nonflammable (no flash point), it is extremely suited for application to a paper regenerating apparatus in the regular office environment as in the case of this invention.

The recording medium subjected to the cleaning liquid is not particularly limited, but marked cleaning effects are obtained with plain paper or recycled paper with the network structure which has been difficult for cleaning as discussed above as well as with resin films (OHP form). Similarly, the printing material subjected to the cleaning liquid of the present invention may be water-soluble and oil-soluble inks and red seal-ink, or felt-pen markers, and are not particularly limited, but it exhibits excellent cleaning effects for toner particles including resin components which are believed to be particularly difficult to clean.

Now, a description is made on the toner used in the developing device. Examples of the resin component to be used include thermoplastic resins or thermosetting resins such as styrene resin, acrylic resin, methacrylic resin, styrene-acrylic copolymerized resin, styrene-butadiene copolymerized resin, polyester resin, epoxy resin, etc. Or copolymers, block polymers, and graft polymers comprising two or more types of these resins or mixtures of these resins may be used. In these resins, it is preferable to use resins whose number average molecular weight Mn is $1000 \leqq Mn \leqq 20000$, more preferably, $2000 \leqq Mn \leqq 15000$ and weight average molecular weight Mw is $2 \leqq Mw \leqq 80$. It is preferable to use the resin whose glass transition temperature is from 55° to 70° C. and softening point is from 80° to 140° C.

For the colorant, various publicly known pigments and dyes can be used. However, if dyes are used as a colorant, dyes are dissolved in the ink removing agent and re-adhere to the recording medium, possibly reducing the cleaning effects. This kind of inconvenience does not give rise to problems when resin films are used, but when paper with the network structure is used, the pulp fiber of the paper is dyed, creating a serious problem. Consequently, for the colorant of the toner used in the developing device, pigments should be used to prevent the colorant from dissolving during cleaning. Examples of the colorants include carbon black, copper oxide, manganese dioxide, aniline black, activated coal, ferrite, magnetite, etc. for black pigment.

Examples of the yellow pigment include chrome yellow, zinc yellow, cadmium yellow, yellow iron oxide, mineral fast yellow, nickel titanium yellow, navel yellow, naphthol yellow S, Hansa yellow G, Hansa yellow 10G, bendizine yellow-G, bendizine yellow-GR, quinoline yellow lake, permanent yellow NCG, Tartrazine lake, etc.

Examples of the red pigment include red chrome yellow, Molybdenum Orange, Permanent Orange GTR, Pirazolone Orange, Vulcanized Orange, Indanthrene Brilliant Orange RK, Bendizine Orange G, Indanthrene Brilliant Orange GK, red ion oxide, cadmium red, red lead, permanent red 4R, lithol red, pyrazolone red, watching red, lake red C, lake red D, brilliant carmine 6B, eosin lake, rhodamine lake B, alizarin lake, brilliant carmine 3B, vulcanized fast orange GG, permanent red FR4H, permanent carmine FB, etc.

Examples of the blue pigment include iron blue, cobalt blue, alkali blue lake, victoria blue lake, phthalocyanine blue, etc. It is desirable to add 1 to 20 parts by weight of these pigments or colorants, preferably 3 to 15 parts by weight with respect to 100 parts by weight of resin component in the toner.

The toner may contain a charge controlling agent. For the positive charge controlling agent that charges the toner positively, nigrosine base EX, quaternary ammonium salt, polyamine compound, imidasol compound, etc. may be used. For the negative charge controlling agent that charges the toner negatively, chromium complex salt type azo dyes, copper phthalocyanine dyes, chromium complex salts, zinc complex salts, aluminum complex salts, etc. may be used.

It is preferable to add 0.1 to 10 parts by weight, preferably 0.5 to 5 parts by weight of these charge controlling agent with respect to 100 parts by weight of the resin component in the toner. Various types of the above-mentioned charge controlling agents may be used. However, if dye-based charge controlling agents are used, as described in the case of the colorant, dyes may dissolve in the cleaning liquid, re-adhere to the recording medium, and reduce cleaning effects. Consequently, it is desirable to use non-dye based charge controlling agent for the toner to be cleaned or to design to eliminate all charge controlling agents. Or, it is desirable to use charge controlling agents which may be colorless or white even when they dissolve. Or, it is desirable to design the toner resin that has a polar group or functional group and as a charge control resin in which the resin component itself possesses the charge control capabilities.

The toner may contain the offset preventing agent. For the offset preventing agent, low molecular weight polyethylene wax, low molecular weight oxygen convertible polyethylene wax, low molecular weight polypropylene wax, low molecular weight oxygen convertible polypropylene wax, higher fatty acid wax, higher fatty ester wax, sazole wax, etc. may be used alone or as a mixture of two or more types. It is desirable to add 1 to 15 parts by weight, preferably, 2 to 8 parts by weight of these offset preventing agents with respect to 100 parts of resin components in the toner. The toner according to this invention may be designed to be a magnetic toner. The magnetic toner is formed by adding metals exhibiting magnetism such as cobalt, iron, nickel, aluminum, lead, magnesium, zinc, antimony, beryllium, Bismuth, cadmium, calcium, manganese, selenium, titanium, tungsten, banadium, etc., oxides and sinters of these metals, alloys comprised of two or more types of these metals, or mixtures comprised of these metals, oxides, sinters, alloys, etc.

It is desirable to add 1 to 80 parts by weight, preferably, 5 to 60 parts by weight of these magnetic substances with respect to 100 parts by weight of the resin components in the toner. The toner according to this invention may contain a superplasticizer. Examples of the superplasticizer include silica fines, titanium oxide fines, alumina fines, magnesium fluoride fines, silicone carbide fines, boron carbide fines, titanium carbide fines, zirconium carbide fines, titanium nitride fines, zirconium nitride fines, magnetite fines, molybdenum disulfate fines, aluminum stearate fines, magnesium stearate fines, zinc stearate fines, and other various inorganic material fines. These inorganic material fines are desirable to be treated to be hydrophobic with the silane coupling agent, titanium coupling agent, higher fatty acid, or silicon oil.

It is also possible to use various organic materials such as styrene base, acrylic base, methacrylic base, benzo guanamine, silicone, Teflon, polyethylene, polypropylene, etc. which are granulated by the wet polymerization such as emulsion polymerization, soap-free emulsion polymerization, nonaqueous dispersion polymerization, etc. or vapor phase method. They can also be used in combination with the above-mentioned nonorganic material fines. It is desirable to add 0.05 to 5 parts by weight, preferably 0.1 to 3 parts by weight of these superplasticizers with respect to 100 parts by weight of the resin component in the toner.

Although the present invention has been fully described by way of the examples with reference to the accompanying drawing, it is to be noted here that various changes and modifications will be apparent to those skilled in the art. Therefore, unless such changes and modifications otherwise depart from the spirit and scope of the present invention, they should be construed as being included therein.

What is claimed is:

1. A regenerating apparatus of a recording medium comprising:

a main body having a conveyor mechanism which conveys a recording medium to be regenerated along a conveyance passage;

a cleaning unit which is removably mounted on said main body, said cleaning unit taking in the recording medium conveyed from said main body to remove an image on the recording medium, said cleaning unit having a U-shaped conveyance passage of the recording medium filled up with a cleaning liquid, and an image removing mechanism which applies a physical treatment to the surface of the recording medium, whereby the recording medium is taken in the U-shaped conveyance passage, immersed in said cleaning liquid so that the image on the recording medium is swollen and removed by said image removing mechanism; and a pre-cleaning unit which is removably mounted on said main body, said pre-cleaning unit having a U-shaped conveyance passage filled up with a cleaning liquid, whereby the recording medium is taken in said U-shaped conveyance passage of said pre-cleaning unit from said main body, immersed in said cleaning liquid so that the image on the recording medium is swollen, and conveyed to said cleaning unit.

2. A regenerating apparatus of a recording medium comprising:

a main body having a conveyor mechanism which conveys a recording medium to be regenerated along a conveyance passage;

a cleaning unit which is removably mounted on said main body, said cleaning unit taking in the recording medium conveyed from said main body to remove an image on the recording medium, said cleaning unit having a U-shaped conveyance passage of the recording medium filled up with a cleaning liquid, and an image removing mechanism which applies a physical treatment to the surface of the recording medium, whereby the recording medium is taken in the U-shaped conveyance passage, immersed in said cleaning liquid so that the image on the recording medium is swollen and removed by said image removing mechanism; and a post-cleaning unit which is removably mounted on said main body, said post-cleaning unit having a U-shaped conveyance passage filled up with a cleaning liquid, whereby the recording medium is taken in said U-shaped conveyance passage of said post-cleaning unit from said cleaning unit, immersed in said cleaning liquid so that a floating toner adhering to the recording medium is washed away, and returned to said main body.

3. A regenerating apparatus of a recording medium comprising:

a main body having a conveyor mechanism which conveys a recording medium to be regenerated along a conveyance passage; and a cleaning unit which is removably mounted on said main body, said cleaning unit taking in the recording medium conveyed from said main body to remove an image on the recording medium, said cleaning unit comprising a convey mechanism which conveys said recording medium to be regenerated along a conveyance passage, a first roll around which a web is wrapped, a second roll which takes up said web wrapped around said first roll, a roller which allows said web fed from said first roll to said second roll to come in contact with said recording medium conveyed by said convey mechanism, and a cleaning liquid applying mechanism which applies a cleaning liquid to said recording medium conveyed by said convey mechanism.

4. A regenerating apparatus as in claim 3, wherein said roller has a built-in heater.

5. A regenerating apparatus as in claim 4, wherein said cleaning liquid applying mechanism is arranged on the upstream side of said feed direction of said web with respect to said roller to apply said cleaning liquid to said web fed from said first roll so that said cleaning liquid is applied to said recording medium via said web.

6. A regenerating apparatus as in claim 3, wherein said cleaning liquid applying mechanism is arranged on the upstream side of said conveyance direction of said recording medium with respect to said roller to apply said cleaning liquid to said recording medium conveyed by said convey mechanism.

7. A regenerating apparatus as in claim 6, wherein said cleaning liquid applying mechanism includes two rollers spaced along said conveyance passage and an applicator belt wrapped around said rollers, whereby said cleaning liquid applying mechanism applies said cleaning liquid to said applicator belt so that said cleaning liquid is applied to said recording medium via said applicator belt.

8. A regenerating apparatus as in claim 7, wherein said cleaning liquid applying mechanism further includes a heater which is arranged in a position opposed to said applicator belt via said conveyance passage of said recording medium to heat said recording medium.

9. A regenerating apparatus of a recording medium comprising:

a main body having a conveyor mechanism which conveys a recording medium to be regenerated along a conveyance passage; and a cleaning unit which is removably mounted on said main body, said cleaning unit taking in the recording medium conveyed from said main body to remove an image on the recording medium, said cleaning unit comprising a convey mechanism which conveys said recording medium to be regenerated along a conveyance passage, a first roll around which a web impregnated with a cleaning liquid previously is wrapped, a second roll which takes up said web wrapped around said first roll, a roller which allows said web fed from said first roll to said second roll to come in contact with said recording medium conveyed by said convey mechanism so that said cleaning liquid is applied to said recording medium via said web.

10. An image forming equipment comprising:

a main body having guide members;

an image forming mechanism which forms an image on a recording medium;

at least one feeder which stores recording media to be used for forming an image, said feeder being removably mounted on said guide members; and a regenerating mechanism which removes an image on a recording medium to be regenerated, said regenerating mechanism being removably mounted on said guide members for said feeder.

11. An image forming equipment as in claim 10 further comprising:

at least one secondary feeder which stores recording media to be used for forming an image, said secondary feeder is separated from said feeder; and a conveyor mechanism which conveys a recording medium regenerated by said regenerating to said secondary feeder.

12. A regenerating unit comprising engaging members on opposite outer side surfaces thereof, said engaging members engaging with guide members provided on a main body of an image forming equipment, said guide members guiding at least one feeder of recording media to removably mount on said main body, whereby said regenerating unit is replaceable with said feeder.

13. A regenerating apparatus of recording medium having a cleaning unit, wherein said cleaning unit comprises:

a conveyor mechanism which conveys a sheet-like recording medium on which print material is printed along a conveyance passage;

a first roll around which a web is wrapped;

a second roll which takes up said web wrapped around said first roll;

a roller which allows said web fed from said first roll to said second roll to come in contact with said recording medium conveyed by said convey mechanism; and a cleaning liquid applying mechanism which applies a cleaning liquid to said recording medium conveyed by said convey mechanism.

14. A regenerating apparatus as in claim 13, wherein said roller has a built-in heater.

15. A regenerating apparatus as in claim 14, wherein said cleaning liquid applying mechanism is arranged on the upstream side of said feed direction of said web with respect to said to apply said cleaning liquid to said web fed from said first roll so that said cleaning liquid is applied to said recording medium via said web.

16. A regenerating apparatus as in claim 13, wherein said cleaning liquid applying mechanism is arranged on the upstream side of said conveyance direction of said recording medium with respect to said roller to apply said cleaning liquid to said recording medium conveyed by said convey mechanism.

17. A regenerating apparatus as in claim 16, wherein said cleaning liquid applying mechanism includes two rollers spaced along said conveyance passage and an applicator belt wrapped around said rollers, whereby said cleaning liquid applying mechanism applies said cleaning liquid to said applicator belt so that said cleaning liquid is applied to said recording medium via said applicator belt.

18. A regenerating apparatus as in claim 17, wherein said cleaning liquid applying mechanism further includes a heater which is arranged in a position opposed to said applicator belt via said conveyance passage of said recording medium to heat said recording medium.

19. A regenerating apparatus of recording medium having a cleaning unit, wherein said cleaning unit comprises:

a conveyor mechanism which conveys a sheet-like recording medium on which print material is printed along a conveyance passage;

a first roll around which a web impregnated with a cleaning liquid previously is wrapped;

a second roll which takes up said web wrapped around said first roll; and a roller which allows said web fed from said first roll to said second roll to come in contact with said recording medium conveyed by said convey mechanism so that said cleaning liquid is applied to said recording medium via said web.

20. An image forming apparatus comprising:

a main body;

image forming means, installed in the main body, for forming an image on a recording medium;

regenerating means, installed in the main body, for removing printed material from a recording medium, said regenerating means being detachable from the main body; and transporting means for transporting a recording medium to the image forming means wherein the image forming apparatus is capable of exchanging the transporting means for the regenerating means.

* * * * *

UNITED STATES PATENT AND TRADEMARK OFFICE

CERTIFICATE OF CORRECTION

PATENT NO. : 5,678,157

DATED : October 14, 1997

INVENTOR(S) : Masazumi Yoshida, et al.

It is certified that error appears in the above-identified patent and that said Letters Patent is hereby corrected as shown below:

Column 1, line 9, delete "recording medium which removes printing material" and insert --for recording medium which removes printing material--.

Column 2, line 10, delete "cleaning unit may have" and insert --cleaning unit may have a--.

Column 2, line 20, delete "the pre-cleaning unit having U-shape" and insert --the pre-cleaning unit having a U-shape--.

Column 2, line 29, delete "the post-cleaning unit having U-shape" and insert --the post-cleaning unit having a U-shape--.

Column 2, line 45, delete "convey mechanism" and insert --conveyor mechanism--.

Column 2, line 51, delete "convey mechanism" and insert --conveyor mechanism--.

Column 5, line 18, delete "cleaning unit 37a, a 37b" and insert --cleaning unit 37a, to 37b--.

Column 16, line 17, delete "a concave which engage" and insert --a concave guide set which engage--.

UNITED STATES PATENT AND TRADEMARK OFFICE

CERTIFICATE OF CORRECTION

PATENT NO. : 5,678,157

DATED : October 14, 1997

INVENTOR(S) : Masazumi Yoshida, et al.

It is certified that error appears in the above-identified patent and that said Letters Patent is hereby corrected as shown below:

Column 17, line 28, delete "installed at the bottom of which a is" and insert --installed at the bottom of which is a--.

Column 18, line 55, delete "lift plate 441" and insert --lift plate 442--.

Column 24, lines 19 and 20, delete "accompanying drawing" and insert --accompanying drawings--.

Column 26, lines 25 and 26, delete "regenerating to said secondary feeder" and insert --regenerating mechanism to said secondary feeder--.

Column 26, line 45, delete "convey mechanism" and insert --conveyor mechanism--.

Column 26, line 48, delete "convey mechanism" and insert --conveyor mechanism--.

Column 26, line 54, delete "to said to apply said cleaning liquid" and insert --to said roller to apply said cleaning liquid--.

UNITED STATES PATENT AND TRADEMARK OFFICE

CERTIFICATE OF CORRECTION

PATENT NO. : 5,678,157

DATED : October 14, 1997

INVENTOR(S) : Masazumi Yoshida, et al.

It is certified that error appears in the above-indentified patent and that said Letters Patent is hereby corrected as shown below:

Column 26, line 61, delete "conveyed by said convey" and insert --conveyed by said conveyor--

Signed and Sealed this

FourthDay of August, 1998

Bruce Lehman

*Attest:*

BRUCE LEHMAN

*Attesting Officer*

*Commissioner of Patents and Trademarks*